US009153880B2

(12) United States Patent
Omori et al.

(10) Patent No.: US 9,153,880 B2
(45) Date of Patent: Oct. 6, 2015

(54) GROUND CONNECTION BODY

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka-shi, Osaka (JP)

(72) Inventors: Yasuo Omori, Yokkaichi (JP); Takeharu Ito, Yokkaichi (JP); Kenta Ito, Yokkaichi (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP)

( * ) Notice: Subject to any disclaimer, the term of this patent is extended or adjusted under 35 U.S.C. 154(b) by 0 days.

(21) Appl. No.: 14/368,944

(22) PCT Filed: Dec. 20, 2012

(86) PCT No.: PCT/JP2012/008159

§ 371 (c)(1),
(2) Date: Jun. 26, 2014

(87) PCT Pub. No.: WO2013/099170

PCT Pub. Date: Jul. 4, 2013

(65) Prior Publication Data

US 2014/0377975 A1 Dec. 25, 2014

(30) Foreign Application Priority Data

Dec. 26, 2011 (JP) ..... 2011-283241

(51) Int. Cl.
*H01R 4/30* (2006.01)
*H01R 4/64* (2006.01)

(Continued)

(52) U.S. Cl.
CPC ..... *H01R 4/305* (2013.01); *H01R 4/185* (2013.01); *H01R 4/64* (2013.01); *H01R 13/28* (2013.01); *H01R 13/652* (2013.01)

(58) Field of Classification Search
CPC ..... H01R 4/18; H01R 4/82; H01R 4/64; H01R 4/00; H01R 13/652
USPC ..... 439/877, 98, 34, 108, 92, 284, 290
See application file for complete search history.

(56) References Cited

U.S. PATENT DOCUMENTS 4,273,401 A * 6/1981 Katzin ..... 439/286
4,357,070 A * 11/1982 Fukushima et al. ..... 439/816

(Continued)

FOREIGN PATENT DOCUMENTS

JP 08-250165 9/1996
JP 2001-298824 10/2001
JP 2004-253167 9/2004

OTHER PUBLICATIONS

International Search Report dated Jan. 29, 2013.

*Primary Examiner* — Tulsidas C Patel
*Assistant Examiner* — Peter G Leigh
(74) *Attorney, Agent, or Firm* — Gerald E. Hespos; Michael J. Porco; Matthew T. Hespos

(57) ABSTRACT

A ground connection body (1) includes a first ground terminal (10), a second ground terminal (20) and a third ground terminal (30). The first ground terminal (10) includes a wire-side terminal portion (4) to be mounted on an end of a ground wire (E1) and a ground-side terminal portion (5) with a first bolt connection hole (6) connectable to a first bolt (G1) and a second bolt connection hole (7) connectable to a second bolt (G2). A second wire-side terminal portion (21) of the second ground terminal (20) is oblique to the first wire-side terminal portion (4) so that a second ground wire (E2) extends toward the first ground wire (E1). A third wire-side terminal portion (31) of the third ground terminal (30) is oblique to the first wire-side terminal portion (4) so that a third ground wire (E3) extends toward the first ground wire (E1).

11 Claims, 17 Drawing Sheets

(51) Int. Cl.

| | |
|---|---|
| ***H01R 13/28*** | (2006.01) |
| ***H01R 13/652*** | (2006.01) |
| ***H01R 4/18*** | (2006.01) |

(56) References Cited

U.S. PATENT DOCUMENTS

| | | | | | |
|---|---|---|---|---|---|
| 5,558,531 | A * | 9/1996 | Ikeda et al. | ..... | 439/287 |
| 5,577,927 | A * | 11/1996 | Okada et al. | ..... | 439/287 |
| 5,586,899 | A * | 12/1996 | Okada | ..... | 439/287 |
| 5,759,055 | A * | 6/1998 | Colantuano et al. | ..... | 439/287 |
| 5,865,637 | A * | 2/1999 | Shinozaki et al. | ..... | 439/287 |
| 5,934,923 | A * | 8/1999 | Matsuoka et al. | ..... | 439/287 |
| 6,036,554 | A * | 3/2000 | Koeda et al. | ..... | 439/797 |
| 6,086,399 | A * | 7/2000 | Matsunaga et al. | ..... | 439/287 |
| 8,366,499 | B2 * | 2/2013 | Shuey et al. | ..... | 439/883 |
| 2002/0132507 | A1 * | 9/2002 | Maeda et al. | ..... | 439/284 |
| 2011/0053434 | A1 * | 3/2011 | Seng et al. | ..... | 439/793 |

* cited by examiner

GROUND CONNECTION BODY

BACKGROUND

1. Field of the Invention

This invention relates to a technique for collectively connecting ground wires to a plurality of ground locations in a vehicle.

2. Description of the Related Art

Conventionally, a ground connection terminal of a joint connector or the like is connected to an end part of a ground wire as disclosed in Japanese Unexamined Patent Publication No. H10-208815 to connect the ground wire included in a vehicle wiring harness to a ground location of the vehicle. The ground connection terminal is connected to the ground location provided on a vehicle body. Specifically, the ground location is, for example, a bolt hole formed on the vehicle body. A hole of the ground terminal is aligned with the position of this bolt hole, a bolt is inserted into the hole of the vehicle body through the hole of the ground terminal and tightened into the bolt hole of the vehicle body with a predetermined tightening force using a tool such as an impact wrench, whereby the ground terminal can be connected to the ground location of the vehicle body.

However, in the above connection structure, the bolt tightening force for the connection of the ground terminal to the ground location of the vehicle body may vary. Such a variation of the bolt tightening force hinders an improvement in reliability in ground terminal connection.

In recent years, also in the case of collectively connecting a plurality of ground wires to ground locations, it has been required to reliably connect the respective ground wires to the ground locations.

In view of the above situation, the present invention aims to provide a ground connection body capable of improving the reliability of ground wire connection to a ground location.

SUMMARY OF THE INVENTION

The present invention is directed to a ground connection body for collectively connecting ground wires to a plurality of ground locations provided on a wall surface in a vehicle, comprising a first wire-side terminal portion shaped to be connectable to an end of a first ground wire; a second wire-side terminal portion shaped to be connectable to an end of a second ground wire different from the first ground wire; and a first ground-side terminal portion electrically connected to each of the first and second wire-side terminal portions, including a first ground location connection part connectable to a first ground location and a second ground location connection part connectable to a second ground location different from the first ground location and having such a relative positional relationship that the first and second ground location connection parts are simultaneously connectable to the first and second ground locations; wherein the second wire-side terminal portion is obliquely arranged relatively with respect to the first wire-side terminal portion so that the second ground wire connected to the second wire-side terminal portion extends in a direction toward the first ground wire connected to the first wire-side terminal portion with distance from the first ground-side terminal portion.

DETAILED DESCRIPTION OF THE PREFERRED EMBODIMENTS

Preferable embodiments of a ground connection body of the present invention are described with reference to the drawings.

(Overall Configuration of Ground Connection Body 1)

Figure 1:
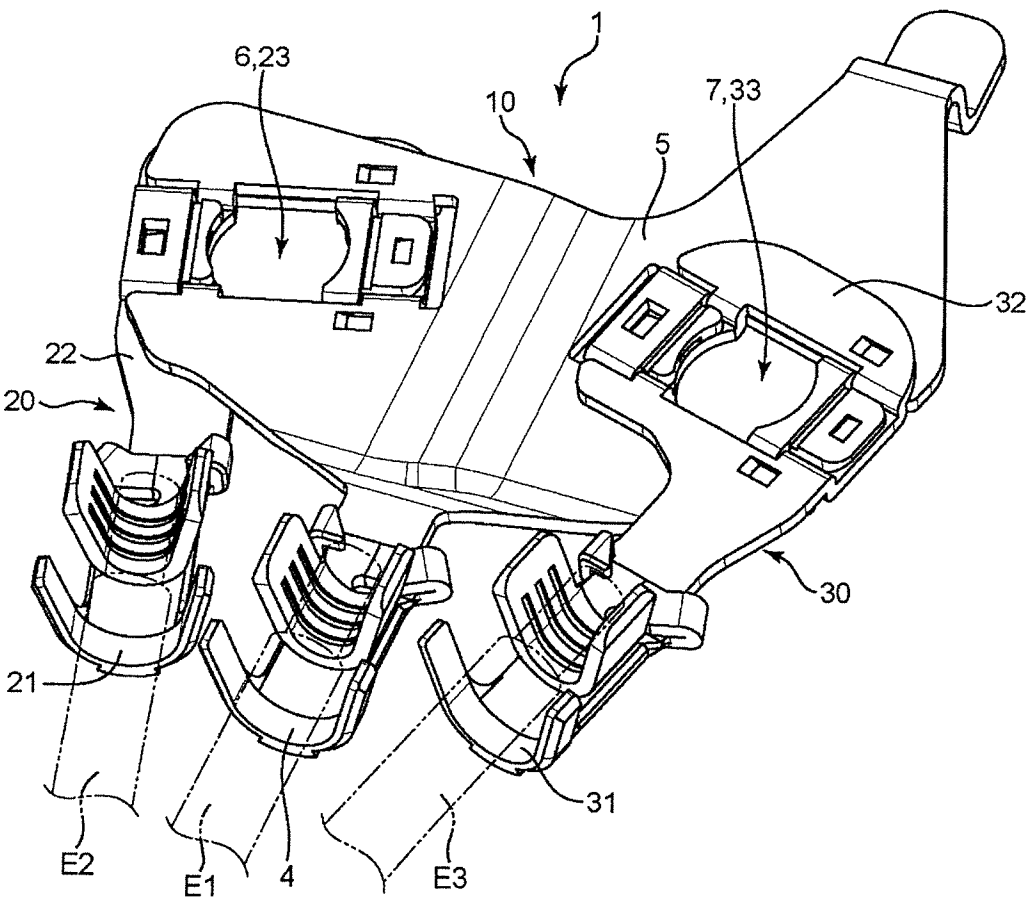
FIG. 1 is a perspective view showing a ground connection body according to a first embodiment of the present invention.
Figure 2:
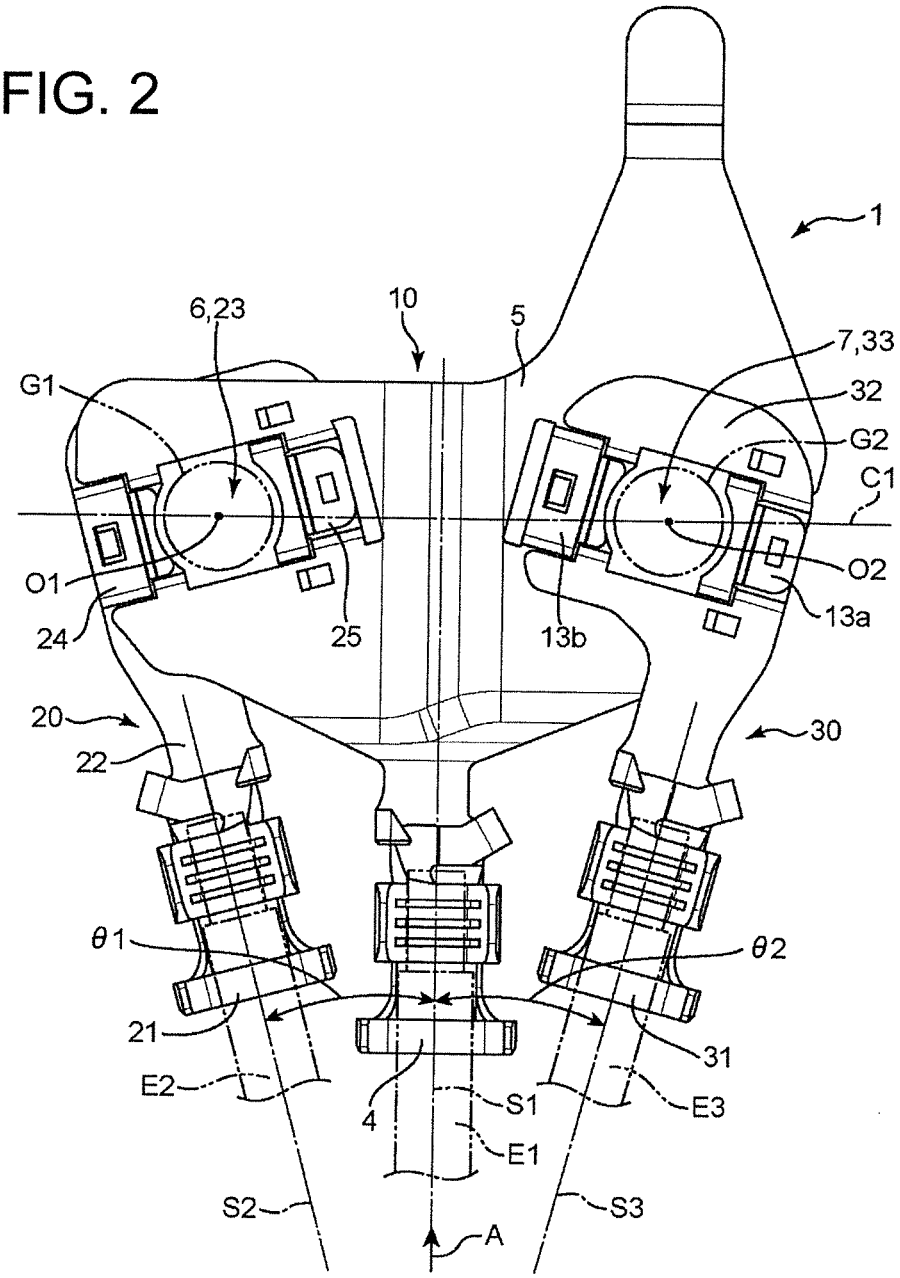
FIG. 2 is a plan view of the ground connection body of FIG. 1.
Figure 3:
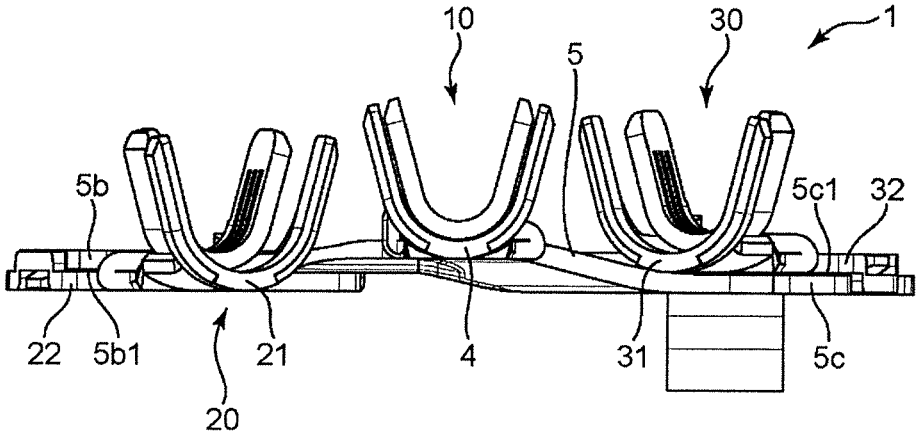
FIG. 3 is a view of the ground connection body of FIG. 2 when viewed in a direction of an arrow A.

As shown in FIGS. 1 to 3, a ground connection body 1 of a first embodiment includes a first ground terminal 10, a second ground terminal 20 and a third ground terminal 30. The ground connection body 1 is structured such that the second and third ground terminals 20, 30 are placed on opposite upper and lower sides of the first ground terminal 10.

First to third ground wires E1 to E3 are the wires respectively pulled out from a specific circuit to be grounded. Each of these ground wires E1 to E3 is composed of a conductor and an insulation coating covering the conductor. These ground wires E1 to E3 are collectively connected to a first bolt G1 and a second bolt G2 fixed to a wall surface of a vehicle or the like via the ground connection body 1. The first bolt G1 is a first ground location. The second bolt G2 is a second ground location. The first and second bolts G1, G2 are, for example, hexagon bolts. The hexagon bolts are threadably engaged with screw holes formed on a vehicle body wall surface. Further, the first and second bolts G1, G2 may be embedded bolts projecting from the vehicle body wall surface. Unillustrated nuts are threadably engaged with the embedded bolts.

The first ground terminal 10 connects the first ground wire E1 to each of the first and second bolts G1, G2 as two ground locations.

The second ground terminal 20 connects the second ground wire E2 to the first bolt G1 and also to the second bolt G2 via the first ground terminal 10.

The third ground terminal 30 connects the third ground wire E3 to the second bolt G2 and also to the first bolt G1 via the first ground terminal 10.

Further, the second ground terminal 20 is obliquely mounted on the first ground terminal 10 so that the second ground wire E2 obliquely extends at an angle θ1 in a direction toward the first ground wire E1.

Furthermore, the third ground terminal 30 is obliquely mounted on the first ground terminal 10 so that the third ground wire E3 obliquely extends at an angle 82 in a direction toward the first ground wire E1.

Next, the configuration of each of the first to third ground terminals 10 to 30 is described in more detail.

(Configuration of First Ground Terminal 10)

As shown in FIGS. 1 to 4, the first ground terminal 10 is a ground terminal shaped to be able to connect the first ground wire E1 to the first and second bolts G1, G2, as a plurality of ground locations provided on the wall surface in the vehicle.

The first ground terminal 10 includes a first wire-side terminal portion 4 and a first ground-side terminal portion 5. The first ground terminal 10 is manufactured of an electrically conductive material.

The first wire-side terminal portion 4 is mounted on an end of the ground wire E1. The first wire-side terminal portion 4 includes a conductor barrel 4*a* and an insulation barrel 4*b*. The conductor barrel 4*a* is a strip-like part with open opposite ends. The conductor barrel 4*a* can wrap around and fix a part of the end of the first ground wire E1 where the conductor is exposed. The insulation barrel 4*b* is arranged side by side with the conductor barrel 4*a*. The insulation barrel 4*b* is a strip-like part with open opposite ends. The insulation barrel 4*b* can wrap around and fix a part of the end of the first ground wire E1 where the conductor is not exposed by being covered by the insulation coating.

The first ground-side terminal portion 5 is in the form of a flat plate including a step portion 5*a* and sized to be connectable to the first and second bolts G1, G2. The first ground-side terminal portion 5 is formed with a first bolt connection hole 6 and a second bolt connection hole 7 respectively at positions corresponding to the first and second bolts G1, G2. The first bolt connection hole 6 is a connection part connectable to the first bolt G1. The second bolt connection hole 7 is a connection part connectable to the second bolt G2. The first and second bolt connection holes 6, 7 are in such a relative positional relationship as to be simultaneously connectable to the first and second bolts G1, G2.

In this first embodiment, a center O1 of the first bolt connection hole 6 and a center O2 of the second bolt connection hole 7 are arranged in a direction C1 perpendicular to an extending direction S1 of an end part of the first ground wire E1 connected to the first wire-side terminal portion 4.

The step portion 5*a* is formed between the first and second bolt connection holes 6, 7. A first part 5*b* of the first ground-side terminal portion 5 where the first bolt connection hole 6 is formed is located higher than a second part 5*c* where the second bolt connection hole 7 is formed. The first and second parts 5*b*, 5*c* are coupled by the step portion 5*a*.

By the first ground-side terminal portion 5 including the step portion 5*a*, a second ground-side terminal portion 22 of the second ground terminal 20 can be arranged below the first part 5*b* and a third ground-side terminal portion 32 of the third ground terminal 30 can be arranged above the second part 5*c* as shown in FIGS. 1 to 3. A height difference between the first and second parts 5*b*, Sc is set at about the thickness of the second ground-side terminal portion 22.

Further, the first ground-side terminal portion 5 includes a first coupling portion 8 and first crimping portions 9 in the first part 5*b*. The first coupling portion 8 is coupled to the second ground terminal 20. The first crimping portions 9 crimp the second ground terminal 20 to the first crimping portion 8, i.e. press the second ground terminal 20 into contact with the first crimping portion 8.

The first coupling portion 8 is coupled to the second ground-side terminal portion 22 in a state where the first bolt connection hole 6 of the first ground-side terminal portion 5 and a first bolt connection hole 23 (see FIG. 5) of the second ground-side terminal portion 22 of the second ground terminal 20 are caused to communicate so as to be simultaneously connectable to the first bolt G1.

Figure 4:
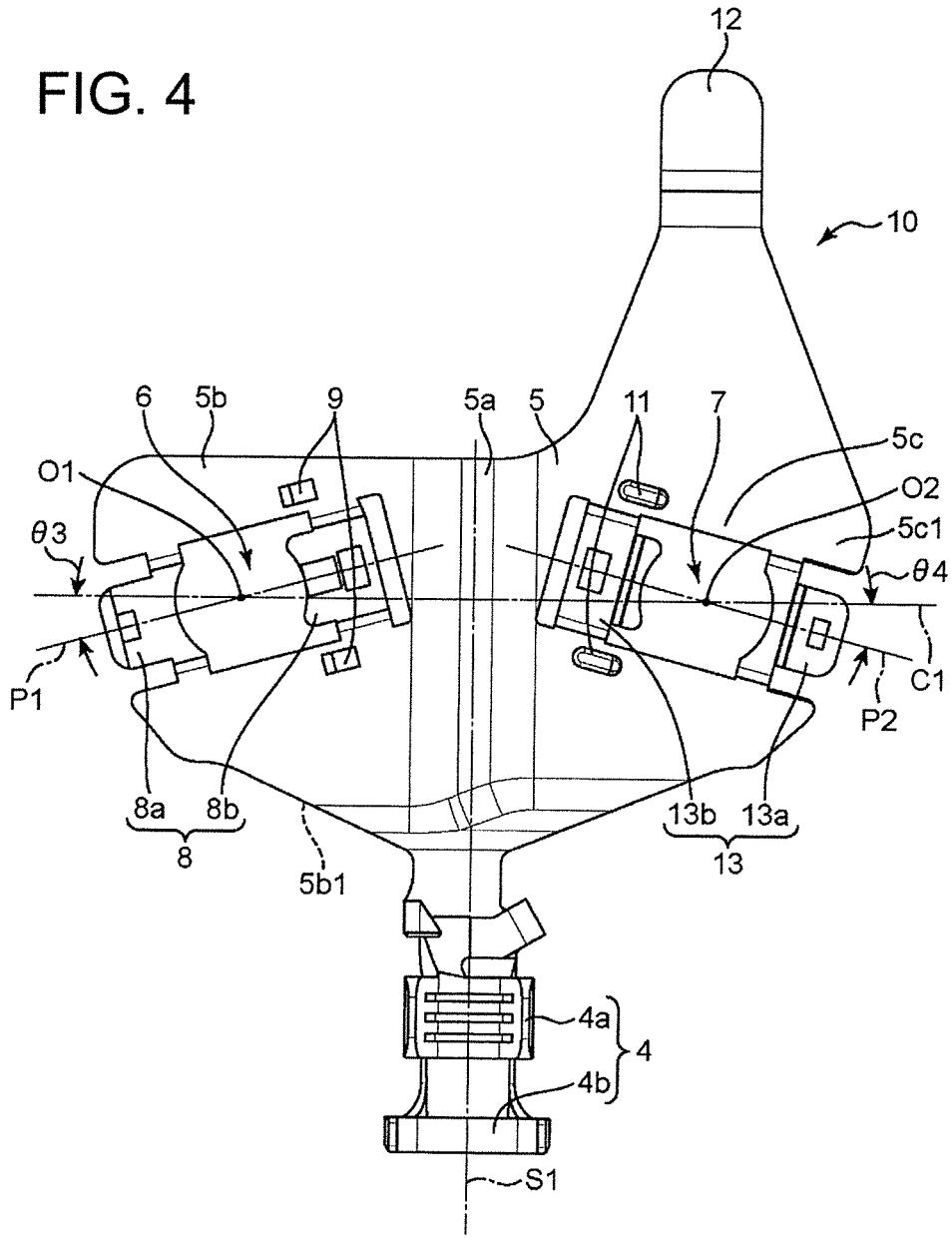
FIG. 4 is a plan view of a first ground terminal of FIG. 2.

As shown in FIG. 4, the first coupling portion 8 includes a contact piece 8*a* and a contact piece 8*b*. The contact pieces 8*a*, 8*b* are arranged at opposite sides of the first bolt connection hole 6 while being slightly inclined. Specifically, an angle θ3 shown in FIG. 4 formed between an arrangement direction P1 of the contact piece 8*a*, 8*b* and the direction C1 perpendicular to the extending direction S1 of the end part of the first ground wire E1 is set to be equal to the angle θ1 (see FIG. 2) of inclination of an extending direction S2 of an end part of the second ground wire E2 connected to a second wire-side terminal portion 21 of the second ground terminal 20 with respect to the extending direction S1 of the end part of the first ground wire E1 connected to the first wire-side terminal portion 4.

The contact pieces 8*a*, 8*b* project in a direction parallel to the above direction P1 and away from the step portion 5*a*.

The contact pieces 8*a*, 8*b* are arranged at positions lower than a lower surface 5*b*1 (see FIGS. 3 and 4) of the first part 5*b* of the first ground-side terminal portion 5. The contact pieces 8*a*, 8*b* are engageable with contact pieces 24, 25 (see FIG. 5) of the second ground-side terminal portion 22 of the second ground terminal 20 to be described later.

The first crimping portions 9 are parts projecting downward from the lower surface 5*b*1 (see FIGS. 3 and 4) of the first part 5*b* of the first ground-side terminal portion 5. The first crimping portions 9 are arranged at opposite sides of the contact piece 8*b* (opposite sides in a direction perpendicular to the arrangement direction P1 of the two connection holes 6, 7). The first crimping portions 9 can press the second ground-side terminal portion 22 of the second ground terminal 20 to be described later toward the contact pieces 8*a*, 8*b* of the first coupling portion 8 and crimp the contact pieces 24, 25 of the second ground-side terminal portion 22 to the contact pieces 8*a*, 8*b* of the first coupling portion 8.

Further, the first ground-side terminal portion 5 includes a second coupling portion 13 and second crimping portions 11 in the second part 5*c*. The second coupling portion 13 is coupled to the third ground terminal 30. The second crimping portions 11 crimp the third ground terminal 30 to the second crimping portion 13, i.e. press the third ground terminal 30 into contact with the second crimping portion 13.

The second coupling portion 13 is coupled to the third ground-side terminal portion 32 in a state where the second bolt connection hole 7 of the first ground-side terminal portion 5 and a second bolt connection hole 33 (see FIG. 6) of the third ground-side terminal portion 32 of the third ground terminal 30 are caused to communicate so as to be simultaneously connectable to the second bolt G2.

As shown in FIG. 4, the second coupling portion 13 includes a contact piece 13*a* and a contact piece 13*b*. The contact pieces 13*a*, 13*b* are arranged at opposite sides of the second bolt connection hole 7 while being slightly inclined. Specifically, an angle θ4 shown in FIG. 4 formed between an arrangement direction P2 of the contact piece 13*a*, 13*b* and the direction C1 perpendicular to the extending direction S1 of the end part of the first ground wire E1 is set to be equal to an angle θ2 (see FIG. 2) of inclination of an extending direction S3 of an end part of the third ground wire E3 connected to the third wire-side terminal portion 31 of the third ground terminal 30 with respect to the extending direction S1 of the end part of the second ground wire E1 connected to the first wire-side terminal portion 4.

The contact pieces 13*a*, 13*b* project in a direction parallel to the above direction P2 and away from the step portion 5*a*.

The contact pieces 13*a*, 13*b* are arranged at positions higher than an upper surface 5*c*1 (see FIGS. 3 and 4) of the second part 5*c* of the first ground-side terminal portion 5. The contact pieces 13*a*, 13*b* are engageable with contact pieces 34, 35 (see FIG. 5) of the third ground-side terminal portion 32 of the third ground terminal 30 to be described later.

The second crimping portions 11 are parts projecting upward from the upper surface 5*c*1 (see FIG. 4) of the second part 5*c* of the first ground-side terminal portion 5. The second crimping portions 11 are arranged at opposite sides of the contact piece 13*b* (opposite sides in a direction perpendicular to the arrangement direction P2 of the two connection holes 6, 7). The second crimping portions 11 can press the third ground-side terminal portion 32 of the third ground terminal 30 to be described later toward the contact pieces 13*a*, 13*b* of the second coupling portion 13 and crimp the contact pieces 34, 35 of the third ground-side terminal portion 32 to the contact pieces 13*a*, 13*b* of the second coupling portion 13.

Further, the second part 5*c* of the first ground-side terminal portion 5 is formed with a locking tongue piece 12 for restricting the rotation of the first ground terminal 10 about the bolts G1, G2 by being fitted into a hole formed on the wall surface at a position distant from the second bolt connection hole 7.

(Configuration of Second Ground Terminal 20)

Figure 5:
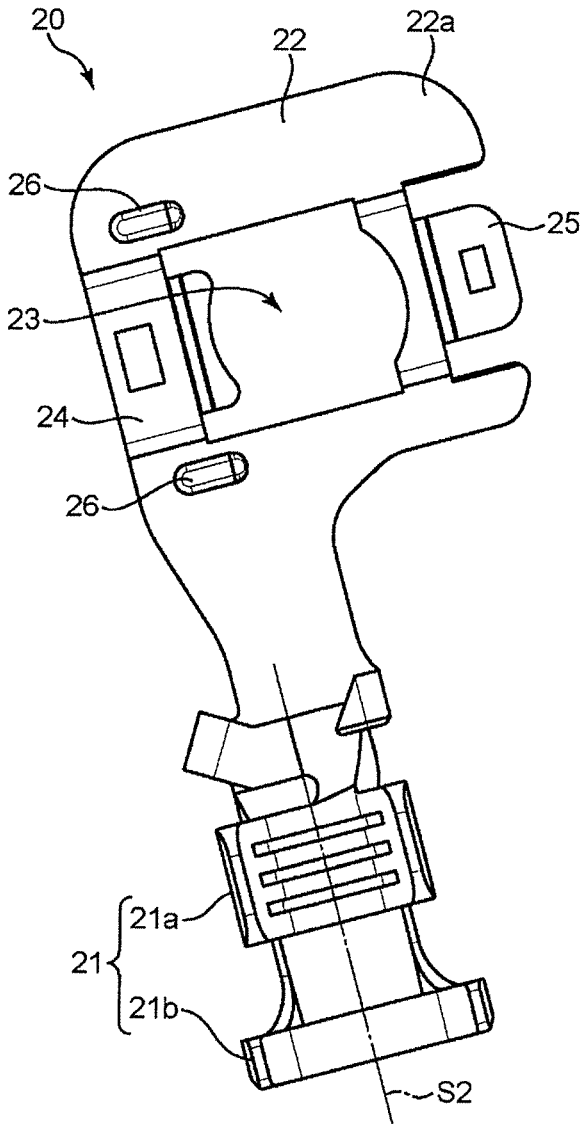
FIG. 5 is a plan view of a second ground terminal of FIG. 2.

As shown in FIG. 5, the second ground terminal 20 includes the second wire-side terminal portion 21 and the second ground-side terminal portion 22. The second ground terminal 20 is manufactured of an electrically conductive material.

As shown in FIGS. 2 and 5, the second wire-side terminal portion 21 and the second ground-side terminal portion 22 are connected to be linearly arranged relative to each other along the extending direction S2 of the end part of the second ground wire E2. This structure is generally adopted in existing ground terminals.

The second wire-side terminal portion 21 is mounted on an end of the second ground wire E2. The second wire-side terminal portion 21 includes a conductor barrel 21*a* and an insulation barrel 21*b*. The conductor barrel 21*a* is a strip-like part with open opposite ends, and can wrap around and fix a part of the end of the second ground wire E2 where the conductor is exposed. The insulation barrel 21*b* is arranged side by side with the conductor barrel 21*a*. The insulation barrel 21*b* is a strip-like part with open opposite ends. The insulation barrel 21*b* can wrap around and fix a part of the end of the second ground wire E2 where the conductor is not exposed by being covered by the insulation coating.

The second ground-side terminal portion 22 is in the form of a flat plate and sized to be able to cover a bolt hole formed on the wall surface of the vehicle with which the first bolt G1 is to be threadably engaged. The second ground-side terminal portion 22 is formed with a first bolt connection hole 23. The first bolt connection hole 23 is a connection part connectable to the first bolt G1.

Further, the second ground-side terminal portion 22 includes the contact pieces 24, 25 to be respectively engaged with the contact pieces 8*a*, 8*b* of the first coupling portion 8 of the above first ground terminal 10. The contact pieces 24, 25 are arranged on opposite sides of the first bolt connection hole 23. The contact pieces 24, 25 project in a direction opposite to the facing direction of the contact pieces 8*a*, 8*b* of the first coupling portion 8 of the above first ground terminal 10. Further, the contact pieces 24, 25 are arranged at positions higher than an upper surface 22*a* of the second ground-side terminal portion 22. The contact pieces 24, 25 are engageable with the upper surfaces of the contact pieces 8*a*, 8*b* of the first ground-side terminal portion 5 of the above first ground terminal 10 while being held in contact therewith. Further, projections are provided on the contact pieces 8*a*, 25 and recesses engageable with these projections are formed on the contact pieces 24, 8*b* to be held in contact with the contact pieces 8*a*, 25. Thus, it becomes more difficult to separate the second ground terminal 20 from the first ground terminal 10 by engaging these projections and recesses.

Furthermore, third crimping portions 26 project upward from the upper surface 22*a* of the second ground-side terminal portion 22. The third crimping portions 26 are arranged at opposite sides of the contact piece 24. The third crimping portions 26 can press the first ground-side terminal portion 5 of the first ground terminal 10 toward the contact pieces 24, 25 and crimp the contact pieces 8*a*, 8*b* of the first ground-side terminal portion 5 to the contact pieces 24, 25.

(Configuration of Third Ground Terminal 30)

Figure 6:
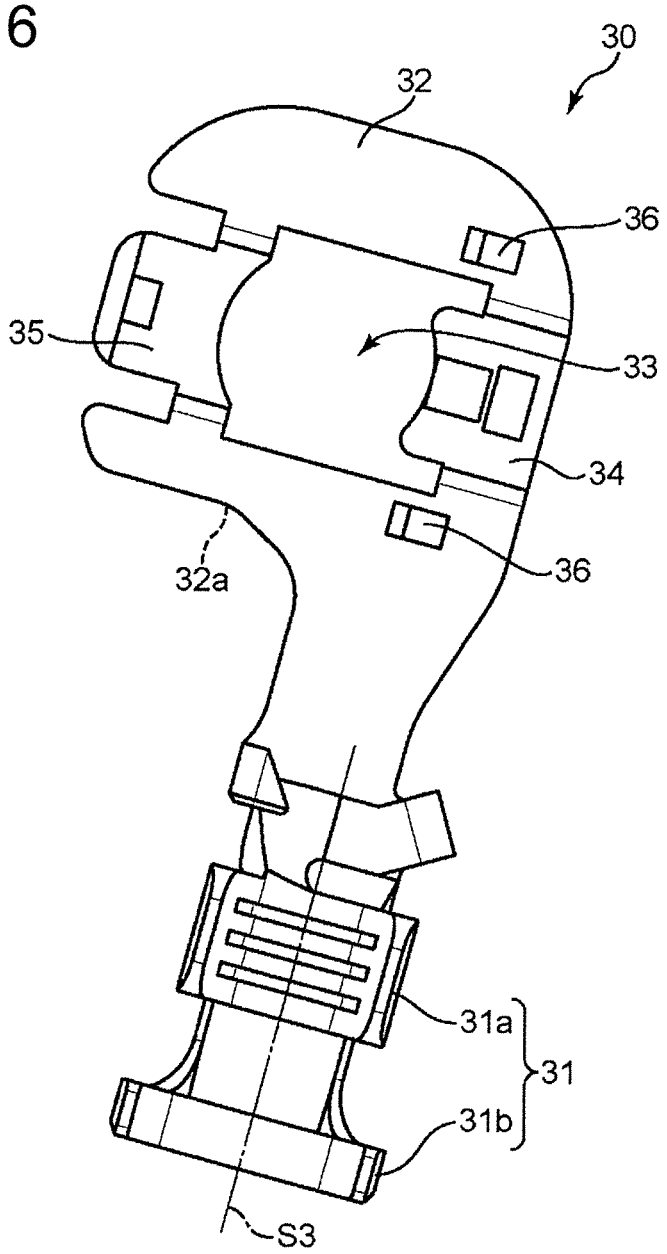
FIG. 6 is a plan view of a third ground terminal of FIG. 2.

As shown in FIG. 6, the third ground terminal 30 includes a third wire-side terminal portion 31 and a third ground-side terminal portion 32. The third ground terminal 30 is manufactured of an electrically conductive material.

As shown in FIGS. 2 and 6, the third wire-side terminal portion 31 and the third ground-side terminal portion 32 are connected to be linearly arranged relative to each other along the extending direction S3 of the end part of the third ground wire E3. This structure is generally adopted in existing ground terminals.

The third wire-side terminal portion 31 is mounted on an end of the third ground wire E3. The third wire-side terminal portion 31 includes a conductor barrel 31*a* and an insulation barrel 31*b*. The conductor barrel 31*a* is a strip-like part with open opposite ends, and can wrap around and fix a part of the end of the third ground wire E3 where the conductor is exposed. The insulation barrel 31*b* is arranged side by side with the conductor barrel 31*a*. The insulation barrel 31*b* is a strip-like part with open opposite ends. The insulation barrel 31*b* can wrap around and fix a part of the end of the third ground wire E3 where the conductor is not exposed by being covered by the insulation coating.

The third ground-side terminal portion 32 is in the form of a flat plate and sized to be able to cover a bolt hole formed on the wall surface of the vehicle with which the second bolt G2 is to be threadably engaged. The third ground-side terminal portion 32 is formed with a second bolt connection hole 33. The second bolt connection hole 33 is a connection part connectable to the second bolt G2.

Further, the third ground-side terminal portion 32 includes the contact pieces 34, 35 to be respectively engaged with the contact pieces 13*a*, 13*b* of the second coupling portion 13 of the above first ground terminal 10. The contact pieces 34, 35 are arranged on opposite sides of the second bolt connection hole 33. The contact pieces 34, 35 project in a direction opposite to the facing direction of the contact pieces 13*a*, 13*b* of the second coupling portion 13 of the above first ground terminal 10. Further, the contact pieces 34, 35 are arranged at positions lower than a lower surface 32*a* (see FIGS. 3 and 6) of the third ground-side terminal portion 32. The contact pieces 34, 35 are engageable with the lower surfaces of the contact pieces 13*a*, 13*b* of the first ground-side terminal portion 5 of the above first ground terminal 10 while being held in contact therewith. Further, projections are provided on the contact pieces 13*a*, 35 and recesses engageable with these projections are formed on the contact pieces 34, 13*b* to be held in contact with the contact pieces 13*a*, 35. Thus, it becomes more difficult to separate the third ground terminal 30 from the first ground terminal 10 by engaging these projections and recesses.

Furthermore, fourth crimping portions 36 project downward from the lower surface 32*a* of the third ground-side terminal portion 32. The fourth crimping portions 36 are arranged at opposite sides of the contact piece 34. The fourth crimping portions 36 can press the first ground-side terminal portion 5 of the first ground terminal 10 toward the contact pieces 34, 35 and crimp the contact pieces 13*a*, 13*b* of the first ground-side terminal portion 5 to the contact pieces 34, 35.

(Assembling Method of Ground Connection Body 1)

Next, an assembling method of the ground connection body 1 of the first embodiment is described with reference to FIGS. 1 to 3.

First, the first, second and third ground wires E1, E2 and E3 are respectively connected to the wire-side terminal portions 4, 21 and 31 of the first, second and third ground terminals 10, 20 and 30 in advance.

Subsequently, the second ground terminal 20 is coupled to the first ground terminal 10. Specifically, as shown in FIGS. 2 and 3, the second ground-side terminal portion 22 of the second ground terminal 20 is placed on the higher first part 5*b* of the first ground-side terminal portion 5 from below. Further, the second ground-side terminal portion 22 is slid in the arrangement direction P1 (see FIG. 4) of the contact pieces 8*a*, 8*b* relative to the first ground-side terminal portion 5 so that the first bolt connection hole 6 of the first ground-side terminal portion 5 and the first bolt connection hole 23 of the second ground-side terminal portion 22 communicate. This causes the contact pieces 24, 25 of the second ground-side terminal portion 22 to be engaged with the upper surfaces of the contact pieces 8*a*, 8*b* of the first coupling portion 8 of the first ground-side terminal portion 5 while being held in contact therewith.

At this time, the first crimping portions 9 of the first ground terminal 10 press the second ground-side terminal portion 22 downwardly and, simultaneously, the third crimping portions 26 of the second ground terminal 20 press the first ground-side terminal portion 5 upwardly. This causes the contact pieces 24, 25 of the second ground terminal 20 to be respectively crimped to the contact pieces 8*a*, 8*b* of the first ground terminal 10, i.e. pressed into contact therewith.

The contact pieces 8*a*, 8*b* of the first coupling portion 8 of the first ground terminal 10 are arranged in the direction P1 inclined by the angle θ3 from the direction C1 perpendicular to the extending direction S1 of the end part of the first ground wire E1. Thus, the first coupling portion 8 can be coupled to the second ground-side terminal portion 22 so that the second wire-side terminal portion 21 is inclined by the angle θ1 equal to the above angle θ3 in a direction toward the first wire-side terminal portion 4 with distance from the first ground-side terminal portion 5.

Thus, as shown in FIG. 2, when the second ground-side terminal portion 22 is coupled to the first coupling portion 8 of the first ground-side terminal portion 5, the second wire-side terminal portion 21 is obliquely arranged with respect to the first wire-side terminal portion 4 so that the second ground wire E2 connected to this second wire-side terminal portion 4 extends in a direction toward the first ground wire E1 connected to the first wire-side terminal portion 4 of the first ground terminal 10 with distance from the first ground-side terminal portion 5.

In this state, the second wire-side terminal portion 21 is obliquely arranged with respect to the first wire-side terminal portion 4 so that an axial direction (same direction as the extending direction S2 of the end part of the second ground wire E2) thereof is inclined with respect to an axial direction (same direction as the extending direction S1 of the end part of the first ground wire E1) of the first wire-side terminal portion 4.

Subsequently, the third ground terminal 30 is coupled to the first ground terminal 10. Specifically, as shown in FIGS. 2 and 3, the third ground-side terminal portion 32 of the third ground terminal 30 is placed on the lower first part 5*c* of the first ground-side terminal portion 5 from above. Further, the third ground-side terminal portion 32 is slid in the arrangement direction P2 (see FIG. 4) of the contact pieces 13*a*, 13*b* relative to the first ground-side terminal portion 5 so that the second bolt connection hole 7 of the first ground-side terminal portion 5 and the second bolt connection hole 33 of the third ground-side terminal portion 32 communicate. This causes the contact pieces 34, 35 of the third ground-side terminal portion 32 to be engaged with the lower surfaces of the contact pieces 13*a*, 13*b* of the second coupling portion 13 of the first ground-side terminal portion 5 while being held in contact therewith.

At this time, the second crimping portions 11 of the first ground terminal 10 press the third ground-side terminal portion 32 upwardly and, simultaneously, the fourth crimping portions 36 of the third ground terminal 30 press the first ground-side terminal portion 5 downwardly. This causes the contact pieces 34, 35 of the third ground terminal 30 to be respectively crimped to the contact pieces 13*a*, 13*b* of the first ground terminal 10, i.e. pressed into contact therewith.

The contact pieces 13*a*, 13*b* of the second coupling portion 13 of the first ground terminal 10 are arranged in the direction P2 inclined by the angle θ4 from the direction C1 perpendicular to the extending direction S1 of the end part of the first ground wire E1. Thus, the third coupling portion 13 can be coupled to the third ground-side terminal portion 32 so that the third wire-side terminal portion 31 is inclined by the angle θ2 equal to the above angle θ4 in a direction toward the first wire-side terminal portion 4 with distance the first ground-side terminal portion 5.

Thus, as shown in FIG. 2, when the third ground-side terminal portion 32 is coupled to the second coupling portion 13 of the first ground-side terminal portion 5, the third wire-side terminal portion 31 is obliquely arranged with respect to the first wire-side terminal portion 4 so that the third ground wire E3 connected to this third wire-side terminal portion 31 extends in a direction toward the first ground wire E1 connected to the first wire-side terminal portion 4 of the first ground terminal 10 with distance from the first ground-side terminal portion 5.

In this state, the third wire-side terminal portion 31 is obliquely arranged with respect to the first wire-side terminal portion 4 so that an axial direction (same direction as the extending direction S3 of the end part of the third ground wire E3) thereof is inclined with respect to an axial direction (same direction as the extending direction S1 of the end part of the first ground wire E1) of the first wire-side terminal portion 4.

In the assembled ground connection body 1, the height of the lower surface of the second part 5*c* of the first ground-side terminal portion 5 located below the third ground-side terminal portion 32 is equal to that of the lower surface of the second ground-side terminal portion 22 as shown in FIG. 3. Thus, this ground connection body 1 can be stably fixed to a mounting surface such as the wall surface of the vehicle.

(Characteristics of First Embodiment)

(1) In the ground connection body 1 of the first embodiment, the first ground-side terminal portion 5 of the first ground terminal 10 includes the first and second bolt connection holes 6, 7 so as to be connectable to each of the first and second bolts G1 G2 as a plurality of ground locations. Thus, if the first ground-side terminal portion 5 is sufficiently connected to at least one of the first and second bolts G1, G2, three ground wires, i.e. the first ground wire E1 connected to the first wire-side terminal portion 4, the second ground wire E2 connected to the second wire-side terminal portion 21 and the third ground wire E3 connected to the third wire-side terminal portion 31, can be connected to at least one of the first and second bolts G1, G2 and reliability can be improved.

In addition, in the above ground connection body 1, the second wire-side terminal portion 21 is obliquely arranged with respect to the first wire-side terminal portion 4 so that the second ground wire E2 connected to the second wire-side terminal portion 21 extends in the direction toward the first ground wire E1 connected to the first wire-side terminal portion 4 with distance from the first ground-side terminal portion 5 in such a configuration in which the first and second bolts G1, G2 are simultaneously connectable. Further, the third wire-side terminal portion 31 is obliquely arranged with respect to the first wire-side terminal portion 4 so that the third ground wire E3 connected to the third wire-side terminal portion 31 extends in the direction toward the first ground wire E1 connected to the first wire-side terminal portion 4 with distance from the first ground-side terminal portion 5. Thus, the second and third ground wires E2, E3 can be obliquely arranged to approach the first ground wire E1 and distances between these wires become smaller. As a result, an arrangement space for the ground wires E1, E2 and E3 can be reduced in the case of collectively connecting a plurality of ground wires E1, E2 and E3 to the first and second bolts G1, G2.

(2) In the ground connection body 1 of the first embodiment, the first ground-side terminal portion 5 needs to have a certain width in the arrangement direction of the first and second bolt connection holes 6, 7 as compared with the direction perpendicular to this arrangement direction. However, in this ground connection body 1, it is possible to suppress an increase of a space taken up by the ground connection body 1 by arranging end parts of the first, second and third wire-side terminal portions 4, 21 and 31 closer to the first ground-side terminal portion 5 in parallel to the arrangement direction of these connection holes 6, 7.

(3) In the ground connection body 1 of the first embodiment, the axial direction of each of the second and third wire-side terminal portions 21 and 31 is inclined with respect to the axial direction of the first wire-side terminal portion 4. Thus, the second and third ground wires E2, E3 can be reliably obliquely arranged to approach the first ground wire E1. As a result, the arrangement space for the ground wires E1, E2 and E3 can be more reliably reduced.

(4) In the ground connection body 1 of the first embodiment, the first ground terminal 10 including the first wire-side terminal portion 4 and the first ground-side terminal portion 5 and the second ground terminal 20 including the second wire-side terminal portion 21 and the second ground-side terminal portion 22 are separately formed. In such a configuration, the second ground-side terminal portion 22 of the second ground terminal 20 is coupled to the first coupling portion 8 of the first ground-side terminal portion 5 of the first ground terminal 10 and the first crimping portions 9 press the second ground-side terminal portion 22 toward the first coupling portion 8 to crimp the second ground-side terminal portion 22 to the first coupling portion 8. This enables the second ground wire E2 connected to the second wire-side terminal portion 21 of the second ground terminal 20 to be reliably connected to at least one of the first and second bolts G1, G2.

Further, in the ground connection body 1 of this first embodiment, the first ground terminal 10 including the first wire-side terminal portion 4 and the first ground-side terminal portion 5 and the third ground terminal 30 including the third wire-side terminal portion 31 and the third ground-side terminal portion 32 are separately formed. In such a configuration, the third ground-side terminal portion 32 of the third ground terminal 30 is coupled to the second coupling portion 13 of the first ground-side terminal portion 5 of the first ground terminal 10 and the second crimping portions 11 press the third ground-side terminal portion 32 toward the second coupling portion 13 to crimp the third ground-side terminal portion 32 to the second coupling portion 13. This enables the third ground wire E3 connected to the third wire-side terminal portion 31 of the third ground terminal 30 to be reliably connected to at least one of the first and second bolts G1, G2.

(5) In the ground connection body 1 of the first embodiment, the second wire-side terminal portion 21 and the second ground-side terminal portion 22 are linearly connected relative to each other and the first coupling portion 8 is so coupled to the second ground-side terminal portion 22 that the second wire-side terminal portion 21 is inclined in the direction toward the first wire-side terminal portion 4 with distance from the first ground-side terminal portion 5. Thus, even in the case of using an existing ground terminal structured such that a wire-side terminal portion and a ground-side terminal portion are linearly connected relative to each other as the second ground terminal 20, the second wire-side terminal portion 21 can be obliquely arranged in the direction toward the first wire-side terminal portion 4 with distance from the first ground-side terminal portion 5 by coupling the second ground-side terminal portion 22 to the first coupling portion 8. This enables the second ground wire E2 connected to the second wire-side terminal portion 21 to be obliquely inclined to approach the first ground wire E1 connected to the first wire-side terminal portion 4 with distance from the first ground-side terminal portion 5 in a manner similar to the above. As a result, a wire arrangement space can be reduced in the case of collectively connecting a plurality of ground wires to the first and second bolts G1, G2. Further, since an existing ground terminal can be utilized as the second ground terminal 20, parts can be shared.

Further, the third wire-side terminal portion 31 and the third ground-side terminal portion 32 are linearly connected relative to each other and the second coupling portion 13 is so coupled to the third ground-side terminal portion 32 that the third wire-side terminal portion 31 is inclined in the direction toward the first wire-side terminal portion 4 with distance from the first ground-side terminal portion 5. Thus, even in the case of using an existing ground terminal structured such that a wire-side terminal portion and a ground-side terminal portion are linearly connected relative to each other as the third ground terminal 30, the third wire-side terminal portion 31 can be obliquely arranged in the direction toward the first wire-side terminal portion 4 with distance from the first ground-side terminal portion 5 by coupling the third ground-side terminal portion 32 to the second coupling portion 13. This enables the third ground wire E3 connected to the third wire-side terminal portion 31 to be obliquely inclined to approach the first ground wire E1 connected to the first wire-side terminal portion 4 with distance from the first ground-side terminal portion 5 in a manner similar to the above. As a result, the wire arrangement space can be reduced in the case of collectively connecting the first to third ground wires E1, E2 and E3 to the first and second bolts G1, G2. Further, since an existing ground terminal can be utilized as the third ground terminal 30, parts can be shared.

(Modifications of First Embodiment)

(A) In the first ground terminal 10 of the above first embodiment and the ground connection body 1 using the same, a structure is shown which includes two connection holes 6, 7 to enable connection to the first and second bolts G1, G2 as two ground locations, but the present invention is not limited to this. A plurality of bolt connection holes may be provided as appropriate according to the number and arrangement of a plurality of ground locations. Also in that case, if at last one ground location out of the first and second bolts G1, G2 is sufficiently connected, ground connection is achieved and the reliability of ground connection can be enhanced as in the first embodiment.

Further, instead of forming the two connection holes 6, 7, a long hole or slit into which the first and second bolts G1, G2 as two ground locations are simultaneously insertable may be formed.

(B) The ground connection body 1 structured such that three ground terminals 10, 20 and 30 composed of different parts are coupled to each other is described in the above first embodiment. However, the present invention is not limited to this. The ground connection body may be structured such that the first ground-side terminal portion 5 and the first to third wire-side terminal portions 4, 21 and 31 are integrally formed. Even in such a structure, the ground wires E1 to E2 connected to the first to third wire-side terminal portions 4, 21 and 3 can be simultaneously connected to the first and second bolts G1, G2 as two ground locations via the first ground-side terminal portion 5. As a result, reliability in connecting the ground wires to the ground locations can be improved. Further, by obliquely arranging the second and third wire-side terminal portions 21, 31 in the directions toward the first wire-side terminal portion 4, the second and third ground wires E2, E3 can be obliquely arranged to extend in the directions toward the first ground wire E1. As a result, the arrangement space can be reduced.

(C) Further, in the above first embodiment, the second and third wire-side terminal portions 21, 31 are obliquely arranged with respect to the first wire-side terminal portion 4 so that the second and third ground wires E2, E3 extend in directions toward the first ground wire E1 with distance from the first ground-side terminal portion 5. However, the present invention is not limited to this. The second and third wire-side terminal portions 21, 31 only have to be obliquely arranged relatively with respect to the first wire-side terminal portion 4 so that the first to third ground wires E1 to E3 extend in directions to approach each other with distance from the first ground-side terminal portion 5. Thus, in the case of the ground connection body structured such that the first ground-side terminal portion 5 and the first to third wire-side terminal portions 4, 21 and 31 are integrally formed, for example, as in the above modification (B), the two wire-side terminal portions other than either the second or third wire-side terminal portion 21 or 31 (i.e. the first and third wire-side terminal portions 4, 31 with respect to the second wire-side terminal portion 21 or the first and second wire-side terminal portions 4, 21 with respect to the third wire-side terminal portion 31) may be obliquely arranged in directions to approach the second or third wire-side terminal portion 21 or 31. Also in that case, the first to third ground wires E1 to E3 can be arranged to extend in directions to approach each other with distance from the first ground-side terminal portion 5. As a result, the arrangement space for the ground wires E1, E2 and E3 can be reduced.

(Overall Configuration of Ground Connection Body 101)

Figure 7:
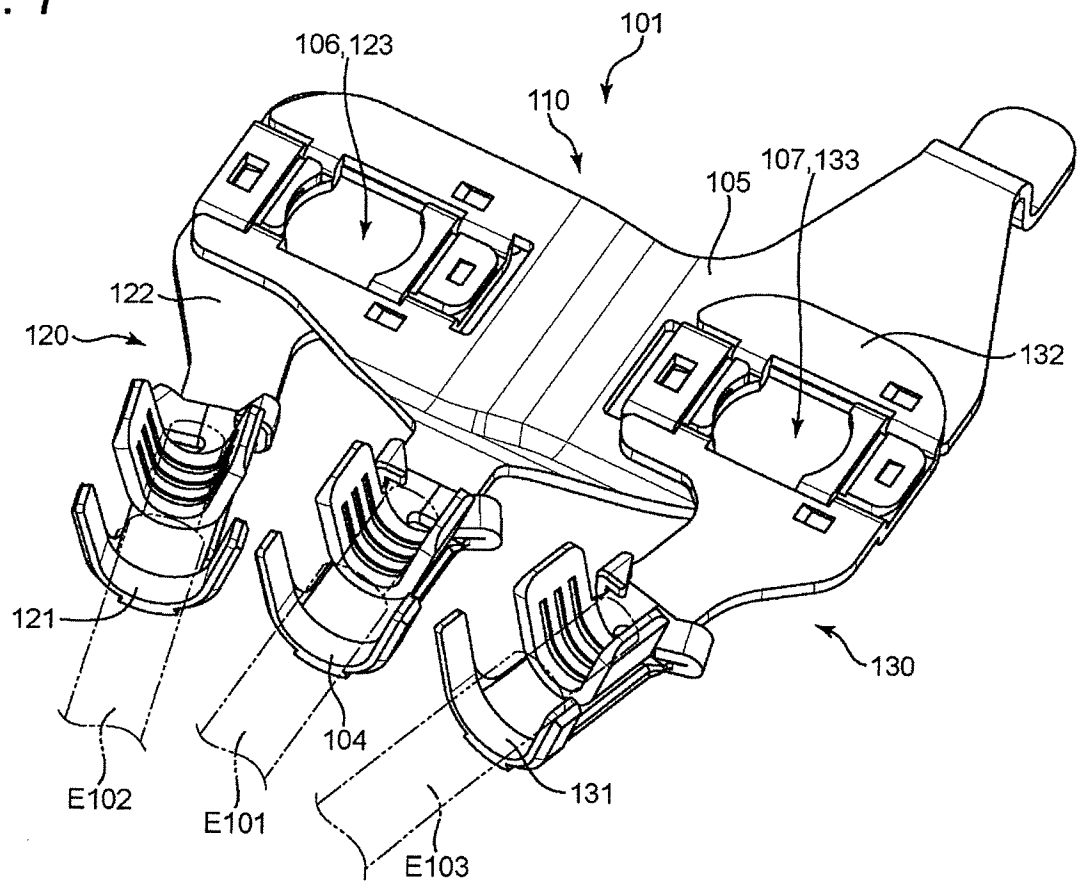
FIG. 7 is a perspective view showing a ground connection body according to a second embodiment of the present invention.
Figure 8:
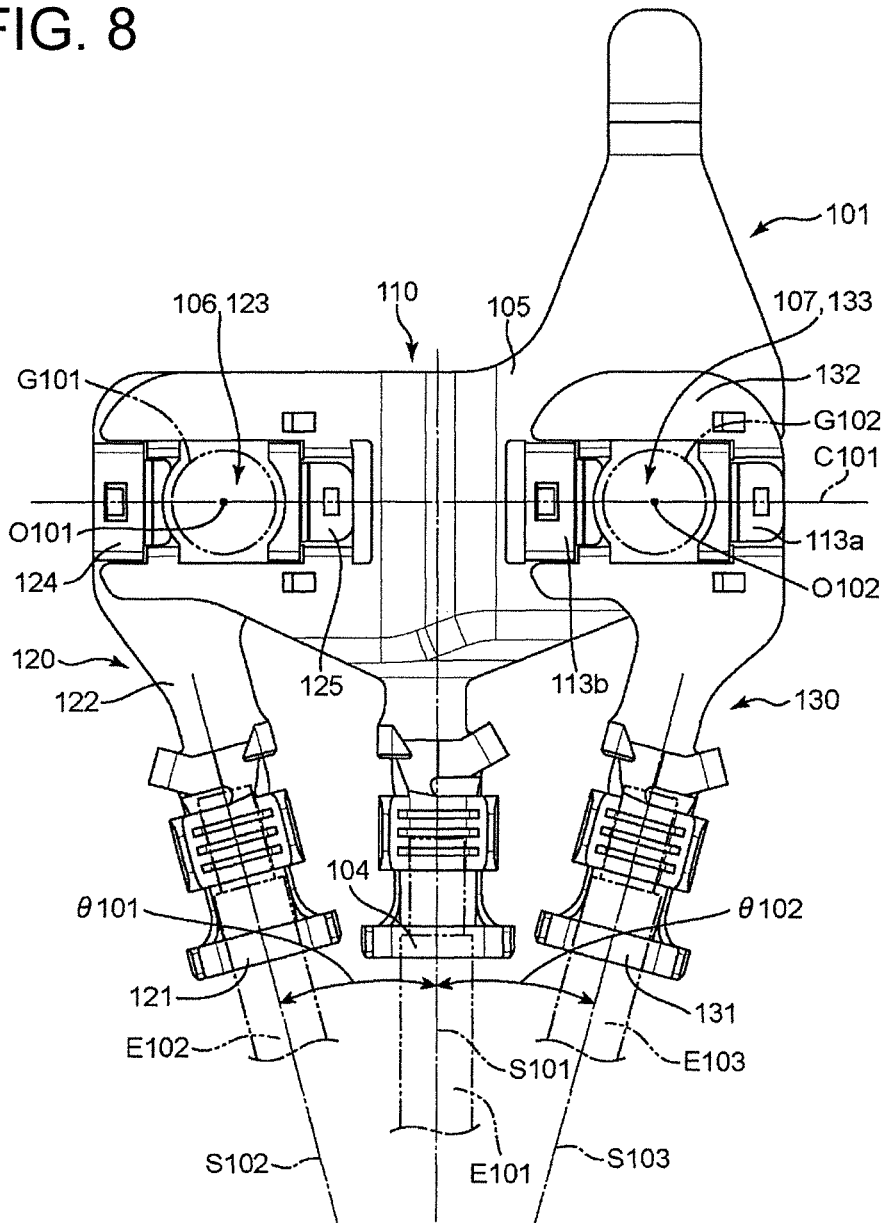
FIG. 8 is a plan view of the ground connection body of FIG. 7.
Figure 9:
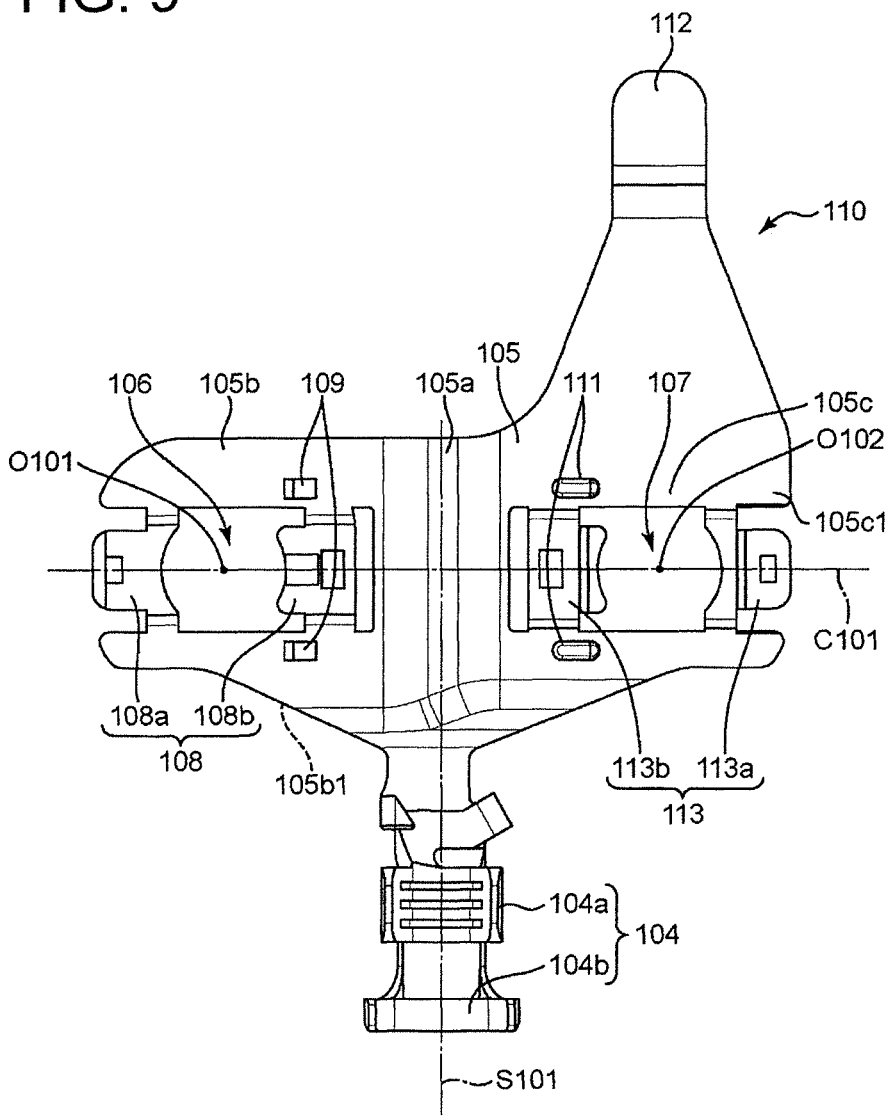
FIG. 9 is a plan view of a first ground terminal of FIG. 8.

As shown in FIGS. 7 to 9, a ground connection body 101 of a second embodiment includes a first ground terminal 110, a second ground terminal 120 and a third ground terminal 130 and is so structured that the second and third ground terminals 120, 130 are placed on opposite upper and lower sides of the first ground terminal 110. In these points, the ground connection body 101 is common to the ground connection body 1 of the above first embodiment. However, the ground connection body 101 differs from the ground connection body 1 of the above first embodiment in that the second and third ground terminals 120, 130 are bent to incline the ground wires E102, E103 on opposite sides toward the ground wire E101 in the center.

Specifically, a second wire-side terminal portion 121 of the second ground terminal 120 is obliquely connected to a second ground-side terminal portion 122 of this second ground terminal 120 so that the second ground wire E102 obliquely extends at an angle θ101 in a direction toward the first ground wire E101. Further, a third wire-side terminal portion 131 of the third ground terminal 130 is obliquely connected to a third ground-side terminal portion 132 of this third ground terminal 130 so that the third ground wire E103 obliquely extends at an angle θ102 in a direction toward the first ground wire E101.

Next, the configuration of each of the first to third ground terminals 110 to 130 is described in more detail.

(Configuration of First Ground Terminal 110)

As shown in FIGS. 7 to 9, the first ground terminal 110 is a ground terminal shaped to be able to connect the first ground wire E101 to a first bolt G101 and a second bolt G102, as a plurality of ground locations provided on a wall surface in a vehicle.

The first ground terminal 110 includes a first wire-side terminal portion 104 and a first ground-side terminal portion 105. The first ground terminal 110 is manufactured of an electrically conductive material.

The first wire-side terminal portion 104 is mounted on an end of the ground wire E101. The first wire-side terminal portion 104 includes a conductor barrel 104*a* and an insulation barrel 104*b* similarly to the first wire-side terminal portion 4 of the above first embodiment.

The first ground-side terminal portion 105 is in the form of a flat plate including a step portion 105*a* and sized to be connectable to the first and second bolts G101, G102. The first ground-side terminal portion 105 is formed with a first bolt connection hole 106 and a second bolt connection hole 107 respectively at positions corresponding to the first and second bolts G101, G102. The first bolt connection hole 106 is a connection part connectable to the first bolt G101. The second bolt connection hole 107 is a connection part connectable to the second bolt G102. The first and second bolt connection holes 106, 107 are in such a relative positional relationship as to be simultaneously connectable to the first and second bolts G101, G102.

In this second embodiment, a center O101 of the first bolt connection hole 106 and a center O102 of the second bolt connection hole 107 are arranged in a direction C101 perpendicular to an extending direction S101 of an end part of the first ground wire E101 connected to the first wire-side terminal portion 104.

The step portion 105*a* is formed between the first and second bolt connection holes 106, 107. A first part 105*b* of the first ground-side terminal portion 105 where the first bolt connection hole 106 is formed is located higher than a second part 105*c* where the second bolt connection hole 107 is formed, and the first and second parts 105*b*, 105*c* are coupled by the step portion 105*a*.

By the first ground-side terminal portion 105 including the step portion 105*a*, the second ground-side terminal portion 122 of the second ground terminal 120 can be arranged below the first part 105*b* and the third ground-side terminal portion 132 of the third ground terminal 130 can be arranged above the second part 105*c* as shown in FIGS. 7 and 8.

Further, the first ground-side terminal portion 105 includes a first coupling portion 108 and first crimping portions 109 in the first part 105*b*. The first coupling portion 108 is coupled to the second ground terminal 120. The first crimping portions 109 crimp the second ground terminal 120 to the first crimping portion 108, i.e. press the second ground terminal 120 into contact with the first crimping portion 108.

The first coupling portion 108 is coupled to the second ground-side terminal portion 122 in a state where the first bolt connection hole 106 of the first ground-side terminal portion 105 and a first bolt connection hole 123 (see FIG. 10) of the second ground-side terminal portion 122 of the second ground terminal 120 are caused to communicate so as to be simultaneously connectable to the first bolt G101.

As shown in FIG. 9, the first coupling portion 108 includes a contact piece 108*a* and a contact piece 108*b*. The contact pieces 108*a*, 108*b* are arranged at opposite sides of the first bolt connection hole 106 (opposite sides in the arrangement direction C101 of the two connection holes 106, 107). The contact pieces 108*a*, 108*b* project in a horizontal direction away from the step portion 105*a*. Further, the contact pieces 108*a*, 108*b* are arranged at positions lower than the lower surface of the first part 105*b* of the first ground-side terminal portion 105. The contact pieces 108*a*, 108*b* are engageable with contact pieces 124, 125 (see FIG. 10) of the second ground-side terminal portion 122 of the second ground terminal 120 to be described later. The contact pieces 108*a*, 108*b* project in a direction parallel to the above direction C101 and away from the step portion 105*a*.

The first crimping portions 109 are parts projecting downward from the lower surface of the first part 105*b* of the first ground-side terminal portion 105 similarly to the first crimping portions 9 of the first embodiment.

Further, the first ground-side terminal portion 105 includes a second coupling portion 113 and second crimping portions 111 in the second part 105*c*. The second coupling portion 113 is coupled to the third ground terminal 130. The second crimping portions 111 crimp the third ground terminal 130 to the second crimping portion 113, i.e. press the third ground terminal 130 into contact with the second crimping portion 113.

The second coupling portion 113 is coupled to the third ground-side terminal portion 132 in a state where the second bolt connection hole 107 of the first ground-side terminal portion 105 and a second bolt connection hole 133 (see FIG. 11) of the third ground-side terminal portion 132 of the third ground terminal 130 are caused to communicate so as to be simultaneously connectable to the second bolt G102.

As shown in FIG. 9, the second coupling portion 113 includes a contact piece 113*a* and a contact piece 113*b*. The contact pieces 113*a*, 113*b* are arranged at opposite sides of the second bolt connection hole 107 (opposite sides in the arrangement direction C101 of the two connection holes 106, 107). The contact pieces 113*a*, 113*b* project in a horizontal direction away from the step portion 105*a*. Further, the contact pieces 113*a*, 113*b* are arranged at positions higher than the upper surface of the second part 105*c* of the first ground-side terminal portion 105. The contact pieces 113*a*, 113*b* are engageable with contact pieces 134, 135 (see FIG. 11) of the third ground-side terminal portion 132 of the third ground terminal 130 to be described later.

The second crimping portions 111 are parts projecting upward from the upper surface of the second part 105*c* of the first ground-side terminal portion 105 similarly to the second crimping portions 11 of the first embodiment.

Further, the second part 105*c* of the first ground-side terminal portion 105 is formed with a locking tongue piece 112 for restricting the rotation of the first ground terminal 110 about the bolts G101, G102 by being fitted into a hole formed on the wall surface at a position distant from the second bolt connection hole 107.

(Configuration of Second Ground Terminal 120)

Figure 10:
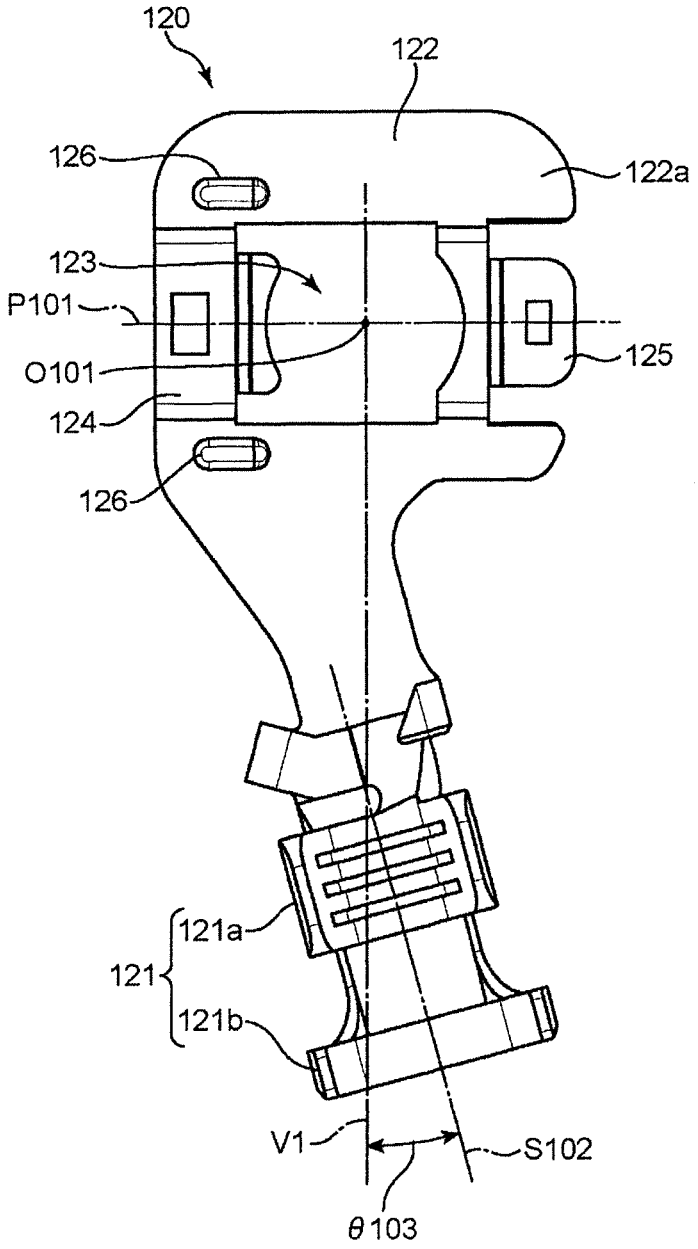
FIG. 10 is a plan view of a second ground terminal of FIG. 8.

As shown in FIG. 10, the second ground terminal 120 includes the second wire-side terminal portion 121 and the second ground-side terminal portion 122. The second ground terminal 120 is manufactured of an electrically conductive material.

As shown in FIGS. 8 and 10, the second wire-side terminal portion 121 is obliquely connected to the second ground-side terminal portion 122 so that the second ground wire E102 connected to the second wire-side terminal portion 121 extends in a direction toward the first ground wire E101 connected to the first wire-side terminal portion 104 with distance from the first ground-side terminal portion 105 in a state where the second ground-side terminal portion 122 is coupled to the first coupling portion 108.

Specifically, as shown in FIGS. 8 and 10, an axial direction (same direction as an extending direction S102 of an end part of the second ground wire E102) of the second wire-side terminal portion 121 is inclined by an angle θ103 equal to an angle θ101 (see FIG. 8) with respect to a direction V1 perpendicular to an arrangement direction P101 of the contact pieces 124, 125 of the second ground-side terminal portion 122 so that the second ground wire E102 obliquely extends at the above angle θ101 in a direction toward the first ground wire E101.

The second wire-side terminal portion 121 is mounted on an end of the second ground wire E102. The second wire-side terminal portion 121 includes a conductor barrel 121*a* and an insulation barrel 121*b* similarly to the first wire-side terminal portion 4 of the above first embodiment.

The second ground-side terminal portion 122 is in the form of a flat plate and sized to be able to cover a bolt hole formed on the wall surface of the vehicle with which the first bolt G101 is to be threadably engaged. The second ground-side terminal portion 122 is formed with the first bolt connection hole 123. The first bolt connection hole 123 is a connection part connectable to the first bolt G101.

Further, the second ground-side terminal portion 122 includes the contact pieces 124, 125 to be respectively engaged with the contact pieces 108*a*, 108*b* of the first coupling portion 108 of the above first ground terminal 110. The contact pieces 124, 125 are arranged on opposite sides of the first bolt connection hole 123. The contact pieces 124, 125 project in a direction opposite to the facing direction of the contact pieces 108*a*, 108*b* of the first coupling portion 108 of the above first ground terminal 110. Further, the contact pieces 124, 125 are arranged at positions higher than an upper surface 122*a* of the second ground-side terminal portion 122. The contact pieces 124, 125 are engageable with the upper surfaces of the contact pieces 108*a*, 108*b* of the first ground-side terminal portion 105 of the above first ground terminal 110 while being held in contact therewith.

Furthermore, third crimping portions 126 project upward from the upper surface 122*a* of the second ground-side terminal portion 122 similarly to the third crimping portions 26 of the above first embodiment.

(Configuration of Third Ground Terminal 130)

Figure 11:
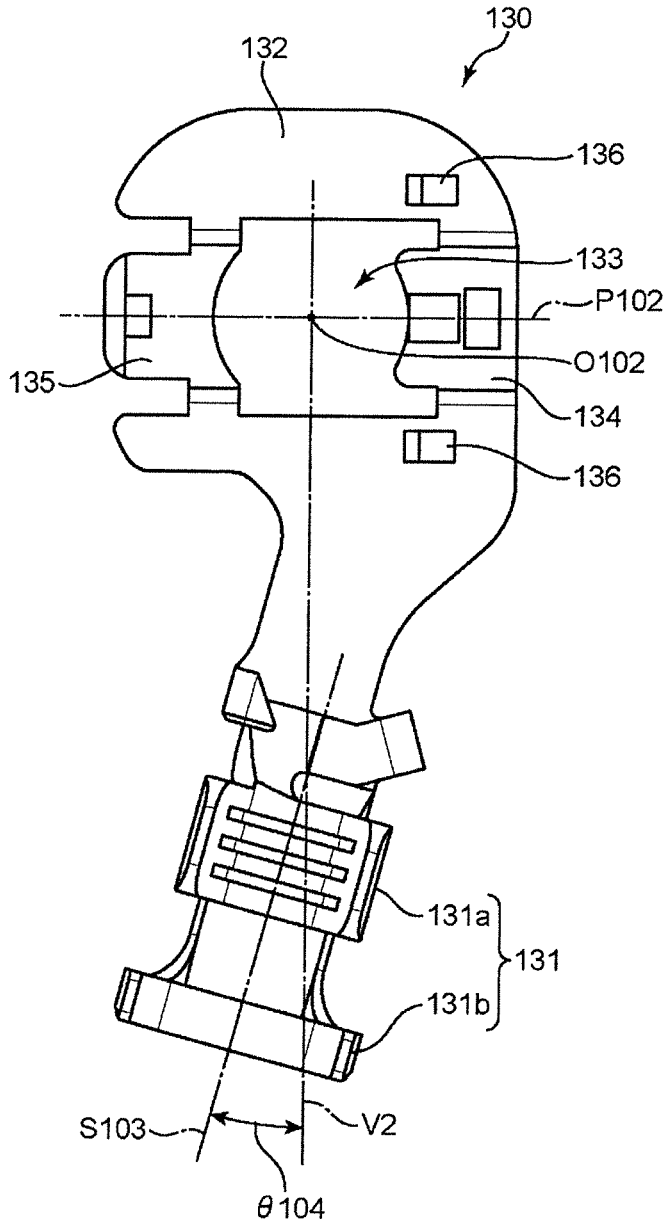
FIG. 11 is a plan view of a third ground terminal of FIG. 8.

As shown in FIG. 11, the third ground terminal 130 includes the third wire-side terminal portion 131 and the third ground-side terminal portion 132. The third ground terminal 130 is manufactured of an electrically conductive material.

As shown in FIGS. 8 and 11, the third wire-side terminal portion 131 is obliquely connected to the third ground-side terminal portion 132 so that the third ground wire E103 connected to the third wire-side terminal portion 131 extends in a direction toward the first ground wire E101 connected to the first wire-side terminal portion 104 with distance from the first ground-side terminal portion 105 in a state where the third ground-side terminal portion 132 is coupled to the second coupling portion 113.

Specifically, as shown in FIGS. 8 and 11, an axial direction (same direction as an extending direction S103 of an end part of the third ground wire E103) of the third wire-side terminal portion 131 is inclined by an angle θ104 equal to an angle 9102 (see FIG. 8) with respect to a direction V2 perpendicular to an arrangement direction P102 of the contact pieces 134, 135 of the third ground-side terminal portion 132 so that the third ground wire E103 obliquely extends at the above angle θ102 in a direction toward the first ground wire E101.

The oblique arrangement of the third wire-side terminal portion 131 with respect to the third ground-side terminal portion 132 in the third ground terminal 130 is in a mirror image relationship with that of the second wire-side terminal portion 121 with respect to the second ground-side terminal portion 122 in the second ground terminal 120.

The third wire-side terminal portion 131 is mounted on an end of the third ground wire E103. The third wire-side terminal portion 131 includes a conductor barrel 131*a* and an insulation barrel 131*b* similarly to the third wire-side terminal portion 31 of the above first embodiment.

The third ground-side terminal portion 132 is in the form of a flat plate and sized to be able to cover a bolt hole formed on the wall surface of the vehicle with which the second bolt G102 is to be threadably engaged. The third ground-side terminal portion 132 is formed with the second bolt connection hole 133. The second bolt connection hole 133 is a connection part connectable to the second bolt G102.

Further, the third ground-side terminal portion 132 includes the contact pieces 134, 135 to be respectively engaged with the contact pieces 113*a*, 113*b* of the second coupling portion 113 of the above first ground terminal 110. The contact pieces 134, 135 are arranged on opposite sides of the second bolt connection hole 133. The contact pieces 134, 135 project in a direction opposite to the facing direction of the contact pieces 113*a*, 113*b* of the second coupling portion 113 of the above first ground terminal 110. Further, the contact pieces 134, 135 are arranged at positions lower than the lower surface of the third ground-side terminal portion 132. The contact pieces 134, 135 are engageable with the lower surfaces of the contact pieces 113*a*, 113*b* of the first ground-side terminal portion 105 of the above first ground terminal 110 while being held in contact therewith.

Furthermore, fourth crimping portions 136 project downward from the lower surface of the third ground-side terminal portion 132 similarly to the crimping portions 36 of the first embodiment.

(Assembling Method of Ground Connection Body 101)

Next, an assembling method of the ground connection body 101 of the second embodiment is described with reference to FIGS. 7 to 9.

First, the first, second and third ground wires E101, E102 and E103 are respectively connected to the wire-side terminal portions 104, 121 and 131 of the first, second and third ground terminals 110, 120 and 130 in advance.

Subsequently, the second ground terminal 120 is coupled to the first ground terminal 110. Specifically, as shown in FIGS. 7 and 8, the second ground-side terminal portion 122 of the second ground terminal 120 is placed on the higher first part 105*b* of the first ground-side terminal portion 105 from below. Further, the second ground-side terminal portion 122 is slid in the direction C101 from the first bolt connection hole 106 to the second bolt connection hole 107 relative to the first ground-side terminal portion 105 so that the first bolt connection hole 106 of the first ground-side terminal portion 105 and the first bolt connection hole 123 of the second ground-side terminal portion 122 communicate. This causes the contact pieces 124, 125 of the second ground-side terminal portion 122 to be engaged with the upper surfaces of the contact pieces 108*a*, 108*b* of the first coupling portion 108 of the first ground-side terminal portion 105 while being held in contact therewith.

At this time, the first crimping portions 109 of the first ground terminal 110 press the second ground-side terminal portion 122 downwardly and, simultaneously, the third crimping portions 126 of the second ground terminal 120 press the first ground-side terminal portion 105 upwardly. This causes the contact pieces 124, 125 of the second ground terminal 120 to be respectively crimped to the contact pieces 108*a*, 108*b* of the first ground terminal 110, i.e. pressed into contact therewith.

In the ground connection body 101 of the second embodiment, the contact pieces 108*a*, 108*b* of the first coupling portion 108 of the first ground terminal 110 are arranged in the direction C101 perpendicular to the extending direction S101 of the end part of the first ground wire E101. On the other hand, the second wire-side terminal portion 121 of the second ground terminal 120 is coupled to the second ground-side terminal portion 122 to be inclined by the angle θ103 equal to the angle θ101 (see FIG. 8) with respect to the direction V1 perpendicular to the arrangement direction P101 of the contact pieces 124, 125 of the second ground-side terminal portion 122 so that the second ground wire E102 obliquely extends at the above angle θ101 in the direction toward the first ground wire E101.

Thus, as shown in FIG. 8, when the second ground-side terminal portion 122 is coupled to the first coupling portion 108 of the first ground-side terminal portion 105, the second wire-side terminal portion 121 is obliquely arranged with respect to the first wire-side terminal portion 104 so that the second ground wire E102 connected to the wire-side terminal portion 121 extends in the direction toward the first ground wire E101 connected to the first wire-side terminal portion 104 of the first ground terminal 110 with distance from the first ground-side terminal portion 105.

In this state, the second wire-side terminal portion 121 is obliquely arranged with respect to the first wire-side terminal portion 104 so that the axial direction (same direction as the extending direction S102 of the end part of the second ground wire E102) thereof is inclined with respect to the axial direction (same direction as the extending direction S101 of the end part of the first ground wire E101) of the first wire-side terminal portion 104.

Subsequently, the third ground terminal 130 is coupled to the first ground terminal 110. Specifically, as shown in FIGS. 7 and 8, the third ground-side terminal portion 132 of the third ground terminal 130 is placed on the lower second part 105*c* of the first ground-side terminal portion 105 from above. Further, the third ground-side terminal portion 132 is slid in the direction C101 from the second bolt connection hole 107 to the first bolt connection hole 106 relative to the first ground-side terminal portion 105 so that the second bolt connection hole 107 of the first ground-side terminal portion 105 and the second bolt connection hole 133 of the third ground-side terminal portion 132 communicate. This causes the contact pieces 134, 135 of the third ground-side terminal portion 132 to be engaged with the lower surfaces of the contact pieces 113*a*, 113*b* of the second coupling portion 113 of the first ground-side terminal portion 105 while being held in contact therewith.

At this time, the second crimping portions 111 of the first ground terminal 110 press the third ground-side terminal portion 132 upwardly and, simultaneously, the fourth crimping portions 136 of the third ground terminal 130 press the first ground-side terminal portion 105 downwardly. This causes the contact pieces 134, 135 of the third ground terminal 130 to be respectively crimped to the contact pieces 113*a*, 113*b* of the first ground terminal 110, i.e. pressed into contact therewith.

In the ground connection body 101 of the second embodiment, the contact pieces 113*a*, 113*b* of the second coupling portion 113 of the first ground terminal 110 are arranged in the direction C101 perpendicular to the extending direction S101 of the end part of the first ground wire E101. On the other hand, the third wire-side terminal portion 131 of the third ground terminal 130 is coupled to the third ground-side terminal portion 132 to be inclined by the angle θ104 equal to the angle θ102 (see FIG. 8) with respect to the direction V2 perpendicular to the arrangement direction P102 of the contact pieces 134, 135 of the third ground-side terminal portion 132 so that the third ground wire E103 obliquely extends at the above angle θ102 in the direction toward the first ground wire E101.

Thus, as shown in FIG. 8, when the third ground-side terminal portion 132 is coupled to the second coupling portion 113 of the first ground-side terminal portion 105, the third wire-side terminal portion 131 is obliquely arranged with respect to the first wire-side terminal portion 104 so that the third ground wire E103 connected to the wire-side terminal portion 131 extends in the direction toward the first ground wire E101 connected to the first wire-side terminal portion 104 of the first ground terminal 110 with distance from the first ground-side terminal portion 105.

In this state, the third wire-side terminal portion 131 is obliquely arranged with respect to the first wire-side terminal portion 104 so that the axial direction (same direction as the extending direction S103 of the end part of the third ground wire E103) thereof is inclined with respect to the axial direction (same direction as the extending direction S101 of the end part of the first ground wire E101) of the first wire-side terminal portion 104.

(Characteristics of Second Embodiment)

(1) In the ground connection body 101 of the second embodiment, the first ground-side terminal portion 105 of the first ground terminal 110 includes the first and second bolt connection holes 106, 107 so as to be connectable to each of the first and second bolts G101, G102 as a plurality of ground locations. Thus, if the first ground-side terminal portion 105 is sufficiently connected to at least one of the first and second bolts G101, G102, three ground wires, i.e. the first ground wire E101 connected to the first wire-side terminal portion 104, the second ground wire E102 connected to the second wire-side terminal portion 121 and the third ground wire E103 connected to the third wire-side terminal portion 131, can be connected to at least one of the first and second bolts G101, G102 and reliability can be improved.

In addition, in the above ground connection body 101, the second wire-side terminal portion 121 is obliquely arranged with respect to the first wire-side terminal portion 104 so that the second ground wire E102 connected to the second wire-side terminal portion 121 extends in the direction toward the first ground wire E101 connected to the first wire-side terminal portion 104 with distance from the first ground-side terminal portion 105 in such a configuration in which the first and second bolts G101, G102 are simultaneously connectable. Further, the third wire-side terminal portion 131 is obliquely arranged with respect to the first wire-side terminal portion 104 so that the third ground wire E103 connected to the third wire-side terminal portion 131 extends in the direction toward the first ground wire E101 connected to the first wire-side terminal portion 104 with distance from the first ground-side terminal portion 105.

Thus, the second ground wire E102 connected to the second wire-side terminal portion 121 and the third ground wire E103 connected to the third wire-side terminal portion 131 can be obliquely arranged to approach the first ground wire E101 connected to the first wire-side terminal portion 104 and distances between these wires become smaller. As a result, an arrangement space for the ground wires E101, E102 and E103 can be reduced in the case of collectively connecting a plurality of ground wires E101, E102 and E103 to the first and second bolts G101, G102.

(2) In the ground connection body 101 of the second embodiment, the first ground-side terminal portion 105 needs to have a certain width in the arrangement direction of the first and second bolt connection holes 106, 107 as compared with the direction perpendicular to this arrangement direction. However, in this ground connection body 101, it is possible to suppress an increase of a space taken up by the ground connection body 101 by arranging end parts of the first, second and third wire-side terminal portions 104, 121 and 131 closer to the first ground-side terminal portion 105 in parallel to the arrangement direction of these connection holes 106, 107.

(3) In the ground connection body 101 of the second embodiment, the axial direction of each of the second and third wire-side terminal portions 121 and 131 is inclined with respect to that of the first wire-side terminal portion 104. Thus, the second ground wire E102 connected to the second wire-side terminal portion 121 and the third ground wire E103 connected to the third wire-side terminal portion 131 can be reliably obliquely arranged to approach the first ground wire E101. As a result, the arrangement space for the ground wires E101, E102 and E103 can be more reliably reduced.

(4) In the ground connection body 101 of the second embodiment, the first ground terminal 110 including the first wire-side terminal portion 104 and the first ground-side terminal portion 105 and the second ground terminal 120 including the second wire-side terminal portion 121 and the second ground-side terminal portion 122 are separately formed. In such a configuration, the second ground-side terminal portion 122 of the second ground terminal 120 is coupled to the first coupling portion 108 of the first ground-side terminal portion 105 of the first ground terminal 110 and the first crimping portions 109 press the second ground-side terminal portion 122 toward the first coupling portion 108 to crimp the second ground-side terminal portion 122 to the first coupling portion 108. This enables the second ground wire E102 connected to the second wire-side terminal portion 121 of the second ground terminal 120 to be reliably connected to at least one of the first and second bolts G101, G102.

Further, in the ground connection body 101 of this second embodiment, the first ground terminal 110 including the first wire-side terminal portion 104 and the first ground-side terminal portion 105 and the third ground terminal 130 including the third wire-side terminal portion 131 and the third ground-side terminal portion 132 are separately formed. In such a configuration, the third ground-side terminal portion 132 of the third ground terminal 130 is coupled to the second coupling portion 113 of the first ground-side terminal portion 105 of the first ground terminal 110 and the second crimping portions 111 press the third ground-side terminal portion 132 toward the second coupling portion 113 to crimp the third ground-side terminal portion 132 to the second coupling portion 113. This enables the third ground wire E103 connected to the third wire-side terminal portion 131 of the third ground terminal 130 to be reliably connected to at least one of the first and second bolts G101, G102.

(5) In the ground connection body 101 of the second embodiment, the second wire-side terminal portion 121 is obliquely connected to the second ground-side terminal portion 122 so that the second ground wire E102 connected to the second wire-side terminal portion 121 extends in the direction toward the first ground wire E101 connected to the first wire-side terminal portion 104 with distance from the first ground-side terminal portion 105 in the state where the second ground-side terminal portion 122 is coupled to the first coupling portion 108. Thus, in performing an operation of coupling the second ground-side terminal portion 122 to the first coupling portion 108, it is not necessary to proceed with the coupling operation while considering an angle of inclination between the first and second ground wires E101 and E102, whereby a reduction in operation speed can be suppressed. In addition, in the state where the second ground-side terminal portion 122 is coupled to the first coupling portion 108, the second wire-side terminal portion 121 can be obliquely arranged in the direction toward the first wire-side terminal portion 104. This enables the second ground wire E102 connected to the second wire-side terminal portion 121 to be obliquely arranged to approach the first ground wire E101 connected to the first wire-side terminal portion 104 with distance from the first ground-side terminal portion 105 as in the above first embodiment. As a result, a wire arrangement space can be reduced in the case of collectively connecting a plurality of ground wires to the first and second bolts G101, G102.

(6) Further, similarly to the above second wire-side terminal portion 121, the third wire-side terminal portion 131 is obliquely connected to the third ground-side terminal portion 132 so that the third ground wire E103 connected to the third wire-side terminal portion 131 extends in the direction toward the first ground wire E101 connected to the first wire-side terminal portion 104 with distance from the first ground-side terminal portion 105 in the state where the third ground-side terminal portion 132 is coupled to the second coupling portion 113. Thus, in performing an operation of coupling the third ground-side terminal portion 132 to the second coupling portion 113, it is not necessary to proceed with the coupling operation while considering an angle of inclination between the first and third ground wires E101 and E103, whereby a reduction in operation speed can be suppressed. In addition, in the state where the third ground-side terminal portion 132 is coupled to the second coupling portion 113, the third wire-side terminal portion 131 can be obliquely arranged in the direction toward the first wire-side terminal portion 104. This enables the third ground wire E103 connected to the third wire-side terminal portion 131 to be obliquely arranged to approach the first ground wire E101 connected to the first wire-side terminal portion 104 with distance from the first ground-side terminal portion 105 as in the above first embodiment. As a result, the wire arrangement space can be reduced in the case of collectively connecting a plurality of ground wires to the first and second bolts G101, G102.

In the ground connection body 1 according to the above first embodiment, the wire-side terminal portions 21, 31 are respectively obliquely arranged on the opposite sides of the first wire-side terminal portion 4. Further, in the ground connection body 101 according to the above second embodiment, the wire-side terminal portions 121, 131 are respectively obliquely arranged on the opposite sides of the first wire-side terminal portion 104. However, a plurality of ground wires can be simultaneously connected to a plurality of ground locations and the arrangement space for the ground wires can be reduced also by obliquely arranging only either one of the wire-side terminal portions 21 and 131 according to the first embodiment or either one of the wire-side terminal portions 121, 131 according to the second embodiment.

Figure 12:
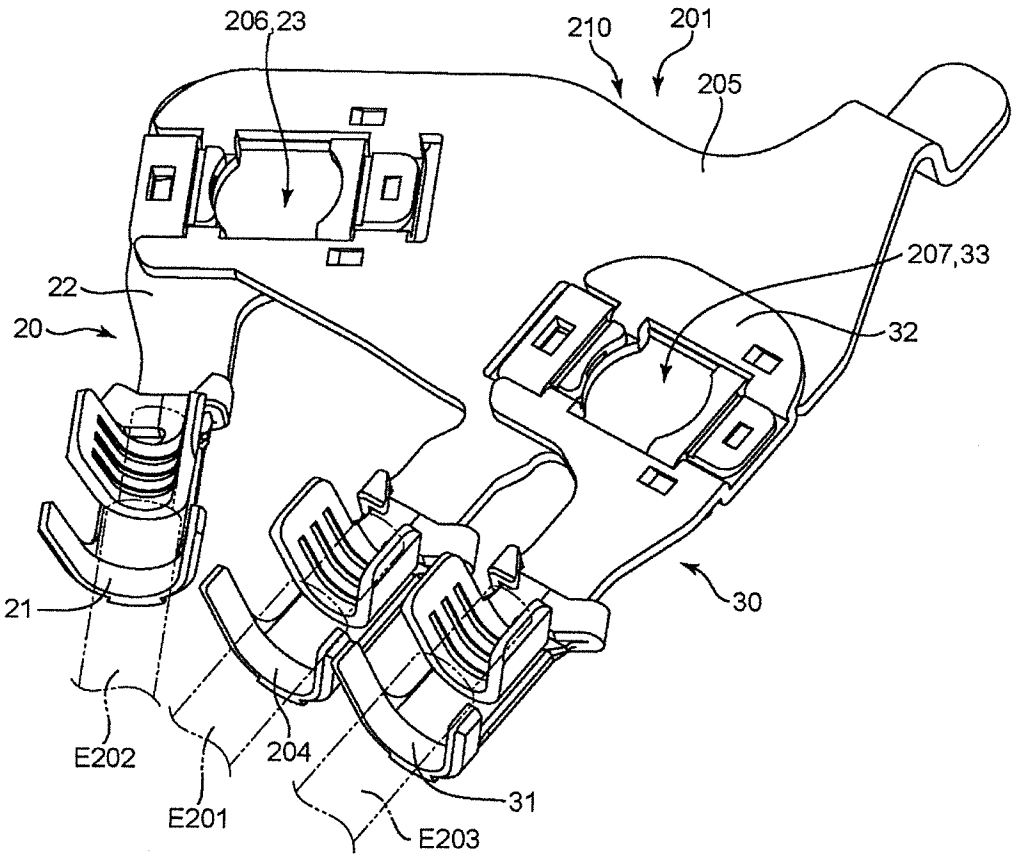
FIG. 12 is a perspective view showing a ground connection body according to a third embodiment of the present invention.
Figure 13:
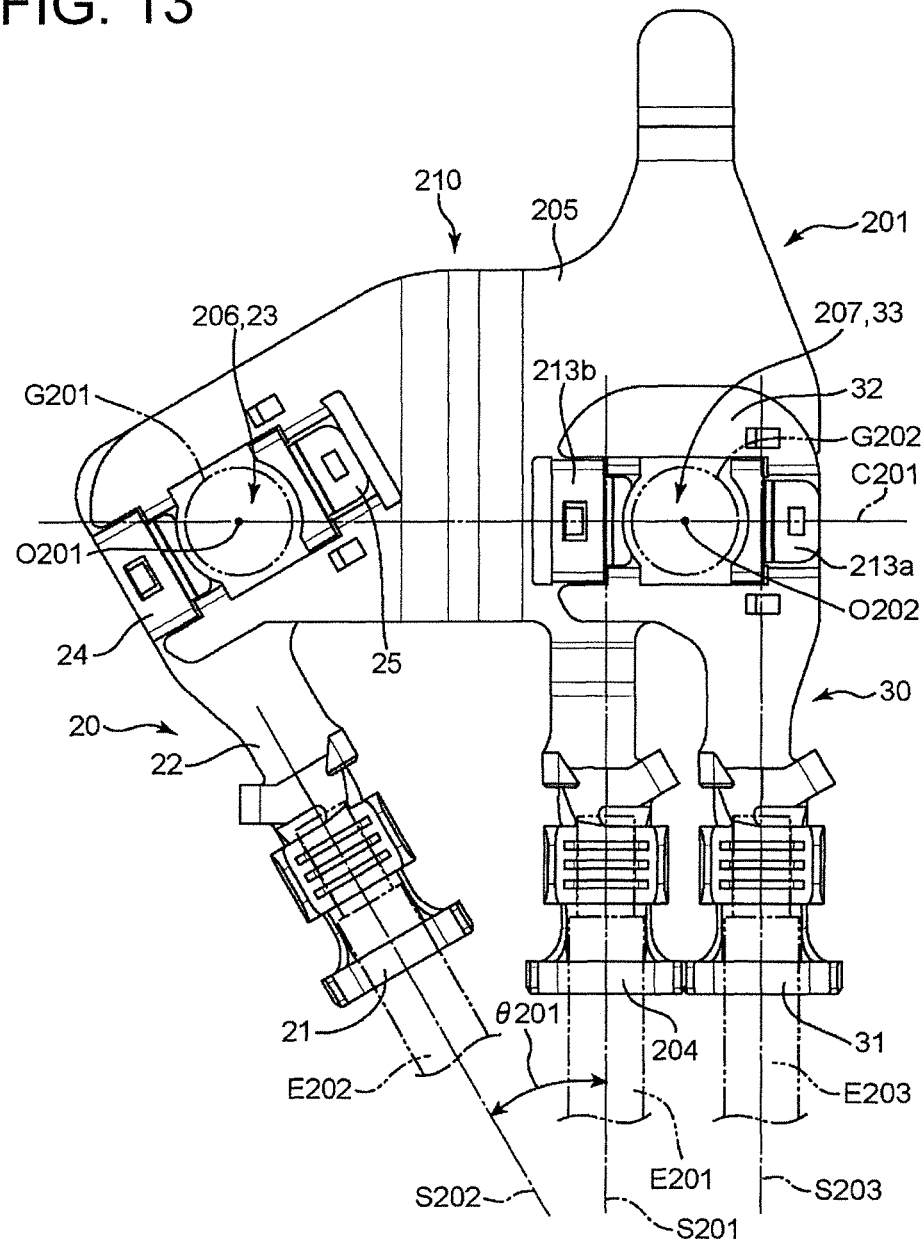
FIG. 13 is a plan view of the ground connection body of FIG. 12.
Figure 14:
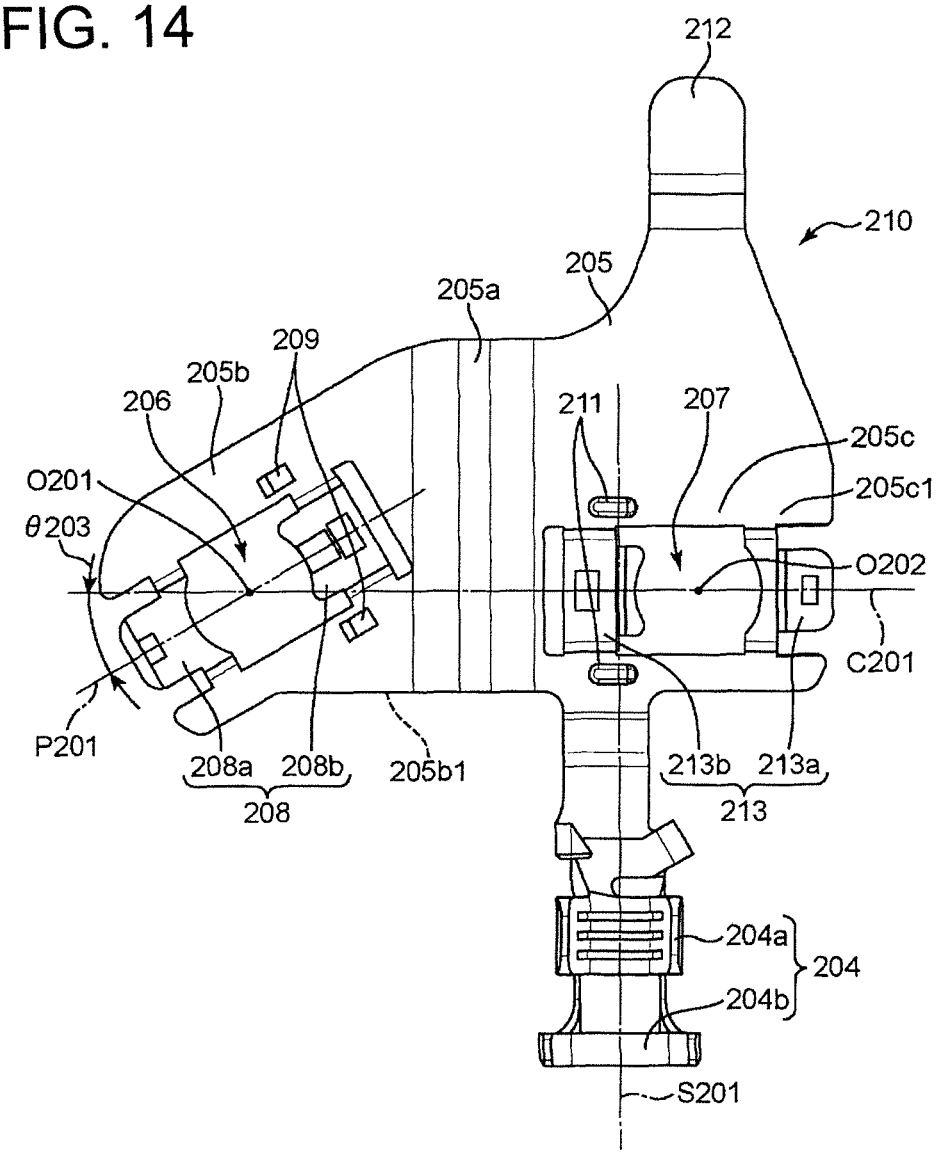
FIG. 14 is a plan view of a first ground terminal of FIG. 13.

For example, in a ground connection body 201 according to a third embodiment, only a second ground terminal 20 is oblique to an axial direction (same as an extending direction S201 of an end part of a first ground wire E201 connected to a first wire-side terminal portion 204) of the first wire-side terminal portion 204 of a first ground terminal 210 as shown in FIGS. 12 to 14. On the other hand, a third ground terminal 30 is arranged parallel to this axial direction.

In this case, out of first to third ground wires E201, E202 and E203 connected to three ground terminals 210, 20 and 30, only the second ground wire E202 can be obliquely arranged to approach the first ground wire E201 in the center. This enables an arrangement space to be reduced as compared with the case where the three ground wires are arranged in parallel.

Specifically, as shown in FIGS. 12 to 14, the ground connection body 201 of the third embodiment includes the first ground terminal 210, the second ground terminal 20 and the third ground terminal 30 and is structured such that the second and third ground terminals 20, 30 are placed on opposite upper and lower sides of the first ground terminal 210.

Here, the second and third ground terminals 20, 30 are common to the second and third ground terminals 20, 30 included in the ground connection body 1 of the first embodiment and each of them is structured similarly to existing ground terminals in which a wire-side terminal portion and a ground-side terminal portion are linearly connected. Any further detailed description is omitted here.

As shown in FIGS. 12 to 14, the first ground terminal 210 is a ground terminal shaped to be able to connect the first ground wire E201 to first and second bolts G201, G202 as a plurality of ground locations provided on a wall surface in a vehicle.

The first ground terminal 210 includes a first wire-side terminal portion 204 and a first ground-side terminal portion 205.

The first wire-side terminal portion 204 is mounted on an end of the ground wire E201, and includes a conductor barrel 204*a* and an insulation barrel 204*b* similarly to the first wire-side terminal portion 4 of the above first embodiment.

The first ground-side terminal portion 205 is in the form of a flat plate including a step portion 205*a* and sized to be connectable to the first and second bolts G201, G202. The first ground-side terminal portion 205 is formed with a first bolt connection hole 206 and a second bolt connection hole 207 respectively at positions corresponding to the first and second bolts G201, G202. The first bolt connection hole 206 is a connection part connectable to the first bolt G201. The second bolt connection hole 207 is a connection part connectable to the second bolt G202. The first and second bolt connection holes 206, 207 are in such a relative positional relationship as to be simultaneously connectable to the first and second bolts G201, G202.

In the third embodiment, a center O201 of the first bolt connection hole 206 and a center O202 of the second bolt connection hole 207 are arranged in a direction C201 perpendicular to the extending direction S201 of the end part of the first ground wire E201 connected to the first wire-side terminal portion 204.

The step portion 205*a* is formed between the first and second bolt connection holes 206, 207. A first part 205*b* of the first ground-side terminal portion 205 where the first bolt connection hole 206 is formed is located higher than a second part 205*c* where the second bolt connection hole 207 is formed, and the first and second parts 205*b*, 205*c* are coupled by the step portion 205*a*.

By the first ground-side terminal portion 205 including the step portion 205*a*, a second ground-side terminal portion 22 of the second ground terminal 20 can be arranged below the first part 205*b* and a third ground-side terminal portion 32 of the third ground terminal 30 can be arranged above the second part 205*c* as shown in FIGS. 7 and 8.

Further, the first ground-side terminal portion 205 includes a first coupling portion 208 and first crimping portions 209 in the first part 205*b*. The first coupling portion 208 is coupled to the second ground terminal 20. The first crimping portions 209 crimp the second ground terminal 20 to the first crimping portion 208, i.e. press the second ground terminal 20 into contact with the first crimping portion 208.

The first coupling portion 208 is coupled to the second ground-side terminal portion 22 in a state where the first bolt connection hole 206 of the first ground-side terminal portion 205 and a first bolt connection hole 23 (see FIG. 5) of the second ground-side terminal portion 22 of the second ground terminal 20 are caused to communicate so as to be simultaneously connectable to the first bolt G201.

As shown in FIG. 14, the first coupling portion 208 includes a contact piece 208*a* and a contact piece 208*b*. The contact pieces 208*a*, 208*b* are arranged at opposite sides of the first bolt connection hole 206 while being slightly inclined. Specifically, an angle θ203 shown in FIG. 14 formed between an arrangement direction P201 of the contact piece 208*a*, 208*b* and the direction C201 perpendicular to the extending direction S201 of the end part of the first ground wire E201 is set to be equal to an angle θ201 (see FIG. 13) of inclination of an extending direction S202 of an end part of the second ground wire E202 connected to the second wire-side terminal portion 21 of the second ground terminal 20 with respect to the extending direction S201 of the end part of the first ground wire E201 connected to the first wire-side terminal portion 204.

The contact pieces 208*a*, 208*b* project in a direction parallel to the above direction P201 and away from the step portion 205*a*.

The first crimping portions 209 are parts projecting downward from the lower surface of the first part 205*b* of the first ground-side terminal portion 205 similarly to the first crimping portions 9 of the first embodiment.

Further, the first ground-side terminal portion 205 includes a second coupling portion 213 and second crimping portions 211 in the second part 205*c*. The second coupling portion 213 is coupled to the third ground terminal 30. The second crimping portions 211 crimp the third ground terminal 30 to the second crimping portion 213, i.e. press the third ground terminal 30 into contact with the second crimping portion 213.

The second coupling portion 213 is coupled to the third ground-side terminal portion 32 in a state where the second bolt connection hole 207 of the first ground-side terminal portion 205 and a second bolt connection hole 33 (see FIG. 6) of the third ground-side terminal portion 32 of the third ground terminal 30 are caused to communicate so as to be simultaneously connectable to the second bolt G202.

As shown in FIG. 14, the second coupling portion 213 includes a contact piece 213*a* and a contact piece 213*b*. The contact pieces 213*a*, 213*b* are arranged at opposite sides of the second bolt connection hole 207 (opposite sides in the arrangement direction C201 of the two connection holes 206, 207). The contact pieces 213*a*, 213*b* project in a horizontal direction away from the step portion 205*a*. Further, the contact pieces 213*a*, 213*b* are arranged at positions higher than the upper surface of the second part 205*c* of the first ground-side terminal portion 205. The contact pieces 213*a*, 213*b* are engageable with contact pieces 34, 35 (see FIG. 6) of the third ground-side terminal portion 32 of the third ground terminal 30 to be described later.

The second crimping portions 211 are parts projecting upward from the upper surface of the second part 205*c* of the first ground-side terminal portion 205 similar to the second crimping portions 11 of the first embodiment.

Further, the second part 205*c* of the first ground-side terminal portion 205 is formed with a locking tongue piece 212 for restricting the rotation of the first ground terminal 210 about the bolts G201, G202 by being fitted into a hole formed on the wall surface at a position distant from the second bolt connection hole 207.

(Assembling Method of Ground Connection Body 201)

Next, an assembling method of the ground connection body 201 of the third embodiment is described with reference to FIGS. 12 to 14.

First, the first, second and third ground wires E201, E202 and E203 are respectively connected to the wire-side terminal portions 204, 21 and 31 of the first, second and third ground terminals 10, 20 and 30 in advance.

Subsequently, the second ground terminal 20 is coupled to the first ground terminal 210 similarly to the ground connection body 1 of the first embodiment.

The contact pieces 208*a*, 208*b* of the first coupling portion 208 of the first ground terminal 210 are arranged in the direction P201 inclined by the angle θ3 from the direction C201 perpendicular to the extending direction S201 of the end part of the first ground wire E201. Thus, the first coupling portion 208 can be coupled to the second ground-side terminal portion 22 so that the second wire-side terminal portion 21 is inclined by the angle θ201 equal to the above angle θ3 in a direction toward the first wire-side terminal portion 204 with distance from the first ground-side terminal portion 205.

Thus, as shown in FIG. 13, when the second ground-side terminal portion 22 is coupled to the first coupling portion 208 of the first ground-side terminal portion 205, the second wire-side terminal portion 21 is obliquely arranged with respect to the first wire-side terminal portion 204 so that the ground wire E202 connected to the second wire-side terminal portion 21 extends in a direction toward the first ground wire E201 connected to the first wire-side terminal portion 204 of the first ground terminal 210 with distance from the first ground-side terminal portion 205.

In this state, the second wire-side terminal portion 21 is obliquely arranged with respect to the first wire-side terminal portion 204 so that an axial direction (same direction as the extending direction S202 of the end part of the second ground wire E202) thereof is inclined with respect to an axial direction (same direction as the extending direction S201 of the end part of the first ground wire E201) of the first wire-side terminal portion 204.

Subsequently, the third ground terminal 30 is coupled to the first ground terminal 210 similarly to the ground connection body 1 of the first embodiment.

In the ground connection body 201 of the third embodiment, the contact pieces 213*a*, 213*b* of the second coupling portion 213 of the first ground terminal 210 are arranged in the direction C201 perpendicular to the extending direction S201 of the end part of the first ground wire E201.

Thus, as shown in FIG. 13, when the third ground-side terminal portion 32 is coupled to the second coupling portion 213 of the first ground-side terminal portion 205, the third wire-side terminal portion 31 is arranged in parallel to the first wire-side terminal portion 204.

In the ground connection body 201 assembled as described above, the second ground wire E202 is arranged to approach the first ground wire E201 with distance from the ground-side terminal portion 205 and, simultaneously, the third ground wire E203 is arranged in parallel to the first ground wire E201. Thus, an arrangement space can be reduced as compared with the case where three ground wires E201 to E203 are arranged in parallel.

Although three ground terminals are combined in the structures of the ground connection bodies according to the above first to third embodiments, the present invention is not limited to this. A ground connection body may be configured by combining two ground terminals such that the two ground terminals can be arranged obliquely to each other.

Figure 15:
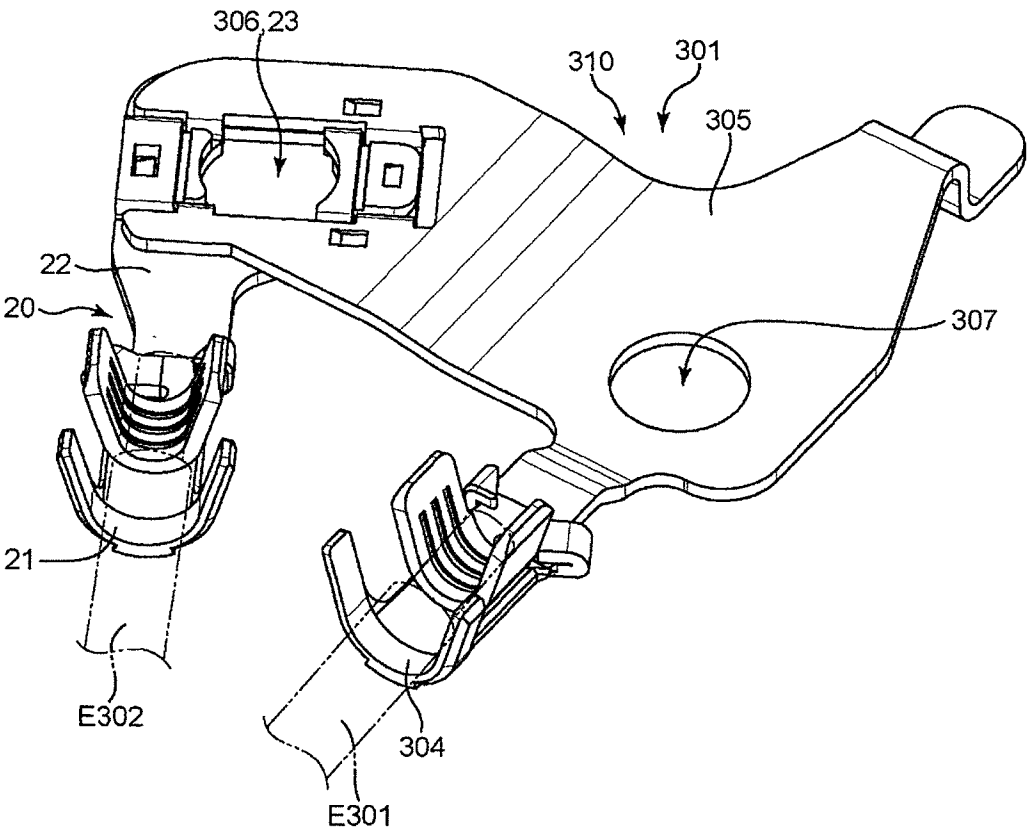
FIG. 15 is a perspective view showing a ground connection body according to a fourth embodiment of the present invention.
Figure 16:
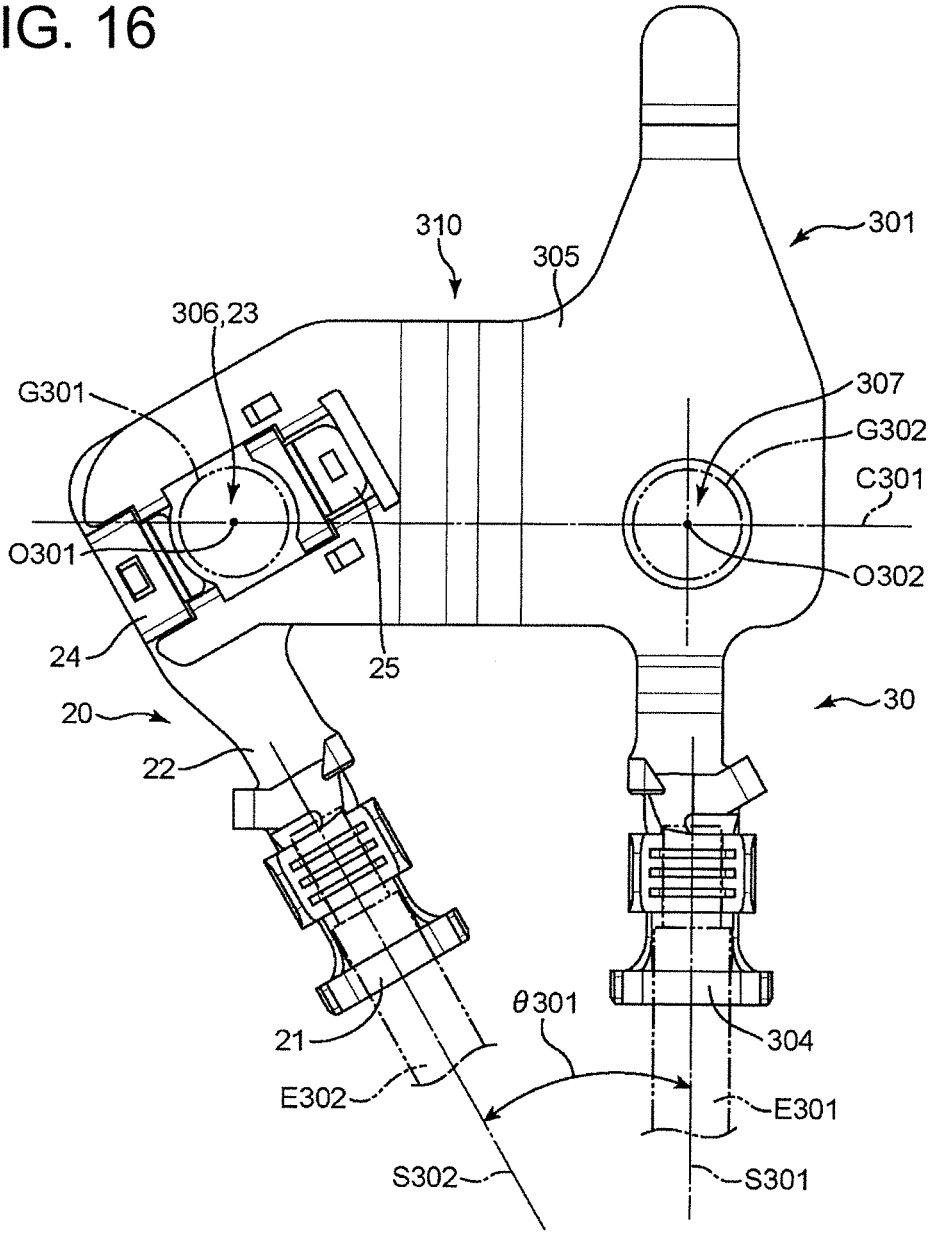
FIG. 16 is a plan view of the ground connection body of FIG. 15.
Figure 17:
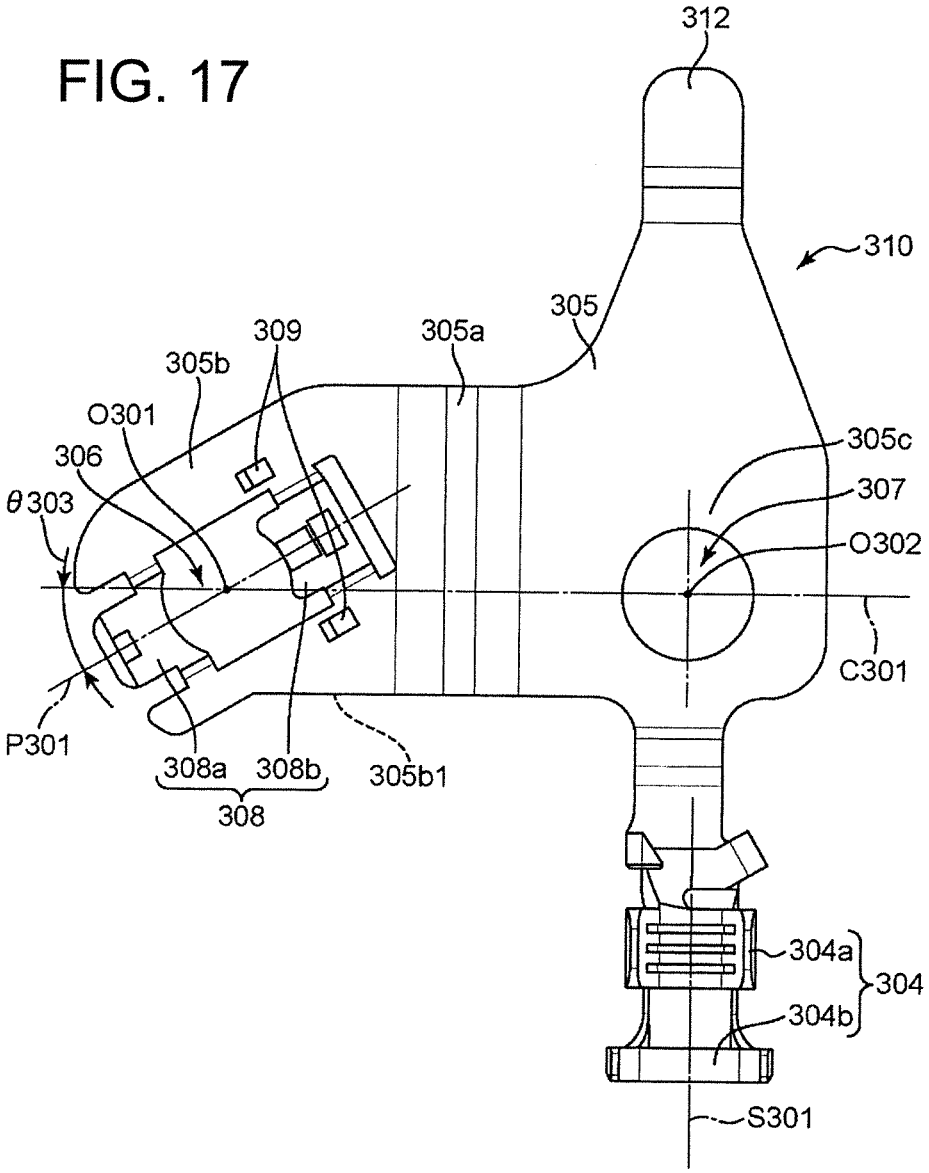
FIG. 17 is a plan view of a first ground terminal of FIG. 16.

For example, a ground connection body 301 according to a fourth embodiment is structured such that a second ground terminal 20 is obliquely arranged with respect to an axial direction (i.e. same as an extending direction S301 of an end part of a first ground wire E301 to be described later) of a first wire-side terminal portion 304 of a first ground terminal 310 as shown in FIGS. 15 to 17. In this configuration, a ground wire E302 connected to a second wire-side terminal portion 21 of the second ground terminal 20 can be obliquely arranged to approach the first ground wire E301. In this way, two ground wires E301, E302 can be simultaneously connected to a plurality of ground locations and an arrangement space can be reduced as compared with the case where two ground wires are arranged in parallel.

The ground connection body 301 of the fourth embodiment is specifically configured as described below and, as shown in FIGS. 15 to 17, includes the first ground terminal 310 and the second ground terminal 20 and is structured such that the second ground terminal 20 is placed on the lower side of the first ground terminal 310.

Here, the second ground terminal 20 is common to the one included in the ground connection body 1 of the first embodiment and structured similarly to existing ground terminals in which a wire-side terminal portion and a ground-side terminal portion are linearly connected. Any further detailed description is omitted here.

As shown in FIGS. 15 to 17, the first ground terminal 310 is a ground terminal shaped to be able to connect the first ground wire E301 to first and second bolts G301, G302 as a plurality of ground locations provided on a wall surface in a vehicle.

The first ground terminal 310 includes a first wire-side terminal portion 304 and a first ground-side terminal portion 305.

The first wire-side terminal portion 304 is mounted on an end of the ground wire E301 and includes a conductor barrel 304*a* and an insulation barrel 304*b* similarly to the first wire-side terminal portion 4 of the above first embodiment.

The first ground-side terminal portion 305 is in the form of a flat plate including a step portion 305*a* and sized to be connectable to the first and second bolts G301, G302. The first ground-side terminal portion 305 is formed with a first bolt connection hole 306 and a second bolt connection hole 307 respectively at positions corresponding to the first and second bolts G301, G302. The first bolt connection hole 306 is a connection part connectable to the first bolt G301. The second bolt connection hole 307 is a connection part connectable to the second bolt G302. The first and second bolt connection holes 306, 307 are in such a relative positional relationship as to be simultaneously connectable to the first and second bolts G301, G302.

In the fourth embodiment, a center O301 of the first bolt connection hole 306 and a center O302 of the second bolt connection hole 307 are arranged in a direction C301 perpendicular to the extending direction S301 of the end part of the first ground wire E301 connected to the first wire-side terminal portion 304.

The step portion 305*a* is formed between the first and second bolt connection holes 306, 307. A first part 305*b* of the first ground-side terminal portion 305 where the first bolt connection hole 306 is formed is located higher than a second part 305*c* where the second bolt connection hole 307 is formed, and the first and second parts 305*b*, 305*c* are coupled by the step portion 305*a*.

By the first ground-side terminal portion 305 including the step portion 305*a*, a second ground-side terminal portion 22 of the second ground terminal 20 can be arranged below the first part 305*b* as shown in FIGS. 15 and 16.

Further, the first ground-side terminal portion 305 includes a first coupling portion 308 and first crimping portions 309 in the first part 305*b*. The first coupling portion 308 is coupled to the second ground terminal 20. The first crimping portions 309 crimp the second ground terminal 20 to the first crimping portion 308, i.e. press the second ground terminal 20 into contact with the first crimping portion 308.

The first coupling portion 308 is coupled to the second ground-side terminal portion 22 in a state where the first bolt connection hole 306 of the first ground-side terminal portion 305 and a first bolt connection hole 23 (see FIG. 5) of the second ground-side terminal portion 22 of the second ground terminal 20 are caused to communicate so as to be simultaneously connectable to the first bolt G301.

As shown in FIG. 17, the first coupling portion 308 includes a contact piece 308*a* and a contact piece 308*b*. The contact pieces 308*a*, 308*b* are arranged at opposite sides of the first bolt connection hole 306 while being slightly inclined. Specifically, an angle θ303 shown in FIG. 17 formed between an arrangement direction P301 of the contact piece 308*a*, 308*b* and the direction C301 perpendicular to the extending direction S301 of the end part of the first ground wire E301 is set to be equal to an angle θ301 (see FIG. 16) of inclination of an extending direction S302 of an end part of the second ground wire E302 connected to the second wire-side terminal portion 21 of the second ground terminal 20 with respect to the extending direction S301 of the end part of the first ground wire E301 connected to the first wire-side terminal portion 304.

The contact pieces 308*a*, 308*b* project in a direction parallel to the above direction P301 and away from the step portion 305*a*.

The first crimping portions 309 are parts projecting downward from the lower surface of the first part 305*b* of the first ground-side terminal portion 305 similarly to the first crimping portions 9 of the first embodiment.

Further, the second part 305*c* of the first ground-side terminal portion 305 is formed with a locking tongue piece 312 for restricting the rotation of the first ground terminal 310 about the bolts G301, G302 by being fitted into a hole formed on the wall surface at a position distant from the second bolt connection hole 307.

(Assembling Method of Ground Connection Body 301)

Next, an assembling method of the ground connection body 301 of the fourth embodiment is described with reference to FIGS. 15 to 17.

First, the first and second ground wires E301, E302 are respectively connected to the wire-side terminal portions 304, 21 of the first and second ground terminals 310, 20 and 30 in advance.

Subsequently, the second ground terminal 20 is coupled to the first ground terminal 310 similarly to the ground connection body 1 of the first embodiment.

The contact pieces 308*a*, 308*b* of the first coupling portion 308 of the first ground terminal 310 are arranged in the direction P301 inclined by the angle θ303 from the direction C301 perpendicular to the extending direction S301 of the end part of the first ground wire E301. Thus, the first coupling portion 308 can be coupled to the second ground-side terminal portion 22 so that the second wire-side terminal portion 21 is inclined by the angle θ301 equal to the above angle θ303 in a direction toward the first wire-side terminal portion 304 with distance from the first ground-side terminal portion 305.

Thus, as shown in FIG. 16, when the second ground-side terminal portion 22 is coupled to the first coupling portion 308 of the first ground-side terminal portion 305, the second wire-side terminal portion 21 is obliquely arranged with respect to the first wire-side terminal portion 304 so that the second ground wire E302 connected to this second wire-side terminal portion 21 extends in a direction toward the first ground wire E301 connected to the first wire-side terminal portion 304 of the first ground terminal 310 with distance from the first ground-side terminal portion 305.

In this state, the second wire-side terminal portion 21 is obliquely arranged with respect to the first wire-side terminal portion 304 so that an axial direction (same direction as the extending direction S302 of the end part of the second ground wire E302) thereof is inclined with respect to an axial direction (same direction as the extending direction S301 of the end part of the first ground wire E301) of the first wire-side terminal portion 304.

In the ground connection body 301 assembled as described above, since the second ground wire E302 is arranged to approach the first ground wire E301 with distance from the ground-side terminal portion 305, an arrangement space can be reduced as compared with the case where two ground wires E301 and E302 are arranged in parallel.

(Modifications of Fourth Embodiment)

Although the second ground terminal 20 in which the second wire-side terminal portion 21 and the second ground-side terminal portion 22 are linearly arranged is obliquely arranged with respect to the first ground terminal 310 to incline the second ground wire E302 in the direction toward the first ground wire E301, the present invention is not limited to this. For example, as shown in FIG. 10 of the above second embodiment, the second ground wire E302 can be inclined in the direction toward the first ground wire E301 also in the case of using the second ground terminal 120 in which the second wire-side terminal portion 121 is obliquely connected to the second ground-side terminal portion 22. By that, an arrangement space can be reduced.

Note that the specific embodiments described above main include inventions having the following configurations.

The above ground connection body is provided with a first ground-side terminal portion including a first ground location connection part connectable to a first ground location and a second ground location connection part connectable to a second ground location, and two wire-side terminal portions (i.e. first and second wire-side terminal portions) connected to the ground-side terminal portion in order to improve reliability in connecting a plurality of ground wires to ground locations.

However, if ground wires connected to the two wire-side terminal portions extend in parallel, there arises a new problem of increasing an arrangement space. Accordingly, to solve such a problem, the two wire-side terminal portions are arranged obliquely to each other in the above ground connection body.

Specifically, the above ground connection body is a ground connection body for collectively connecting ground wires to a plurality of ground locations provided on a wall surface in a vehicle and provided with a first wire-side terminal portion shaped to be connectable to an end of a first ground wire, a second wire-side terminal portion shaped to be connectable to an end of a second ground wire different from the first ground wire, and a first ground-side terminal portion electrically connected to each of the first and second wire-side terminal portions, including a first ground location connection part connectable to a first ground location and a second ground location connection part connectable to a second ground location different from the first ground location and having such a relative positional relationship that the first and second ground location connection parts are simultaneously connectable to the first and second ground locations, wherein the second wire-side terminal portion is obliquely arranged relatively with respect to the first wire-side terminal portion so that the second ground wire connected to the second wire-side terminal portion extends in a direction toward the first ground wire connected to the first wire-side terminal portion with distance from the first ground-side terminal portion.

According to such a configuration, the first ground-side terminal portion includes the first and second ground location connection parts so as to be connected to a plurality of ground locations. Thus, if at least one of the ground locations is sufficiently connected, the first ground wire connected to the first wire-side terminal portion and the second ground wire connected to the second wire-side terminal portion can be connected to the ground location. As a result, reliability can be improved.

In addition, in the above ground connection body, the second wire-side terminal portion is obliquely arranged relatively with respect to the first wire-side terminal portion so that the second ground wire connected to the second wire-side terminal portion extends in the direction toward the first ground wire connected to the first wire-side terminal portion with distance from the first ground-side terminal portion in such a configuration simultaneously connectable to the plurality of ground locations. Thus, the second ground wire connected to the second wire-side terminal portion can be obliquely arranged to approach the first ground wire connected to the first wire-side terminal portion. Therefore, a distance between these wires becomes shorter, with the result that a wire arrangement space can be reduced in the case of collectively connecting the plurality of ground wires to the ground locations.

End parts of the first and second wire-side terminal portions closer to the first ground-side terminal portion are preferably arranged in a direction parallel to an arrangement direction of the first and second ground location connection parts of the first ground-side terminal portion.

According to such a configuration, the first ground-side terminal portion needs to have a certain width in the arrangement direction of the first and second ground location connection parts as compared with a direction perpendicular to this arrangement direction. However, it is possible to suppress an increase of a space taken up by the ground connection body by arranging the end parts of the first and second wire-side terminal portions closer to the first ground-side terminal portion in parallel to the arrangement direction of these connection parts.

Further, the second wire-side terminal portion is preferably obliquely arranged relatively with respect to the first wire-side terminal portion so that an axial direction thereof is inclined with respect to that of the first wire-side terminal portion.

According to such a configuration, the axial direction of the second wire-side terminal portion is inclined with respect to that of the first wire-side terminal portion. Thus, the second ground wire connected to the second wire-side terminal portion can be reliably obliquely arranged to approach the first ground wire connected to the first wire-side terminal portion. As a result, the wire arrangement space can be more reliably reduced.

Furthermore, preferably, a second ground-side terminal portion is further provided which includes a first ground location connection part connectable to the first ground location in addition to the first ground-side terminal portion, the ground connection body includes a first ground terminal and a second ground terminal, the first ground terminal is formed by connecting the first wire-side terminal portion and the first ground-side terminal portion, the second ground terminal is formed by connecting the second wire-side terminal portion and the second ground-side terminal portion, the first ground-side terminal portion includes a first coupling portion to be coupled to the second ground-side terminal portion in such a relative positional relationship that the first ground location connection part of the first ground-side terminal portion and the first ground location connection part of the second ground-side terminal portion are simultaneously connectable to the first ground location and a first crimping portion configured to crimp the second ground-side terminal portion to the first coupling portion by pressing the second ground-side terminal portion toward the first coupling portion.

According to such a configuration, in the case of including each of the first ground terminal with the first wire-side terminal portion and the first ground-side terminal portion and the second ground terminal with the second wire-side terminal portion and the second ground-side terminal portion, the second ground-side terminal portion of the second ground terminal is coupled to the first coupling portion of the first ground-side terminal portion of the first ground terminal and the first crimping portion crimps the second ground-side terminal portion to the first coupling portion by pressing the second ground-side terminal portion toward the first coupling portion. Thus, the second ground wire connected to the second wire-side terminal portion of the second ground terminal can be reliably connected to at least one of the first and second ground locations.

Further, preferably, the second wire-side terminal portion and the second ground-side terminal portion are linearly connected relative to each other and the first coupling portion is coupled to the second ground-side terminal portion so that the second wire-side terminal portion is inclined in a direction toward the first wire-side terminal portion with distance from the first ground-side terminal portion.

According to such a configuration, even if an existing ground terminal structured such that a wire-side terminal portion and a ground-side terminal portion are linearly arranged relative to each other as the second ground terminal, the second wire-side terminal portion can be obliquely arranged in the direction toward the first wire-side terminal portion with distance from the first ground-side terminal portion by coupling the second ground-side terminal portion to the first coupling portion. This enables the second ground wire connected to the second wire-side terminal portion to be obliquely inclined to approach the first ground wire connected to the first wire-side terminal portion with distance from the first ground-side terminal portion in a manner similar to the above. Thus, the wire arrangement space can be reduced in the case of collectively connecting a plurality of ground wires to the ground locations. Further, since an existing ground terminal can be utilized as the second ground terminal, parts can be shared.

Further, the second wire-side terminal portion is preferably obliquely connected to the second ground-side terminal portion so that the second ground wire connected to the second wire-side terminal portion extends in a direction toward the first ground wire connected to the first wire-side terminal portion with distance from the first ground-side terminal portion in a state where the second ground-side terminal portion is coupled to the first coupling portion.

According to such a configuration, the second wire-side terminal portion is obliquely connected to the second ground-side terminal portion. Thus, in performing an operation of coupling the second ground-side terminal portion to the first coupling portion, it is not necessary to proceed with the coupling operation while considering an angle of inclination between the first ground wire and the second ground wire, whereby a reduction in operation speed can be suppressed. In addition, in the state where the second ground-side terminal portion is coupled to the first coupling portion, the second wire-side terminal portion can be obliquely arranged in the direction toward the first wire-side terminal portion. This enables the second ground wire connected to the second wire-side terminal portion to be obliquely arranged to approach the first ground wire connected to the first wire-side terminal portion with distance from the first ground-side terminal portion in a manner similar to the above. As a result, the wire arrangement space can be reduced in the case of collectively connecting a plurality of ground wires to the ground locations.

Further, preferably, a third wire-side terminal portion is further provided which is shaped to be connectable to an end of a third ground wire different from the first and second ground wires, and the third wire-side terminal portion is electrically connected to the first ground-side terminal portion and obliquely arranged relatively with respect to the first wire-side terminal portion so that the third ground wire connected to the third wire-side terminal portion extends in a direction toward the first ground wire connected to the first wire-side terminal portion with distance from the first ground-side terminal portion.

According to such a configuration, the third wire-side terminal portion is obliquely arranged relatively with respect to the first wire-side terminal portion so that the third ground wire connected to the third wire-side terminal portion extends in the direction toward the first ground wire connected to the first wire-side terminal portion with distance from the first ground-side terminal portion. Thus, the third ground wire connected to the third wire-side terminal portion can be obliquely arranged to approach the first ground wire connected to the first wire-side terminal portion. In this way, distances between these wires become shorter, with the result that the wire arrangement space can be reduced in the case of collectively connecting the first to third ground wires to the ground locations.

The third wire-side terminal portion is preferably obliquely arranged relatively with respect to the first wire-side terminal portion so that an axial direction thereof is inclined with respect to that of the first wire-side terminal portion.

According to such a configuration, the axial direction of the third wire-side terminal portions is inclined with respect to that of the first wire-side terminal portion. Thus, the third ground wire connected to the third wire-side terminal portion can be reliably obliquely arranged to approach the first ground wire connected to the first wire-side terminal portion. This enables the wire arrangement space to be more reliably reduced.

Further, preferably, a third ground-side terminal portion is further provided which includes a second ground location connection part connectable to the second ground location in addition to the first ground-side terminal portion, the ground connection body includes a first ground terminal and a third ground terminal, the first ground terminal is formed by connecting the first wire-side terminal portion and the first ground-side terminal portion, the third ground terminal is formed by connecting the third wire-side terminal portion and the third ground-side terminal portion, the first ground-side terminal portion includes a second coupling portion to be coupled to the third ground-side terminal portion in such a relative positional relationship that the second ground location connection part of the first ground-side terminal portion and the second ground location connection part of the third ground-side terminal portion are simultaneously connectable to the second ground location and a second crimping portion configured to crimp the third ground-side terminal portion to the second coupling portion by pressing the third ground-side terminal portion toward the second coupling portion.

According to such a configuration, in the case of including each of the first ground terminal with the first wire-side terminal portion and the first ground-side terminal portion and the third ground terminal with the third wire-side terminal portion and the third ground-side terminal portion, the third ground-side terminal portion of the third ground terminal is coupled to the second coupling portion of the first ground-side terminal portion of the first ground terminal and the second crimping portion crimps the third ground-side terminal portion to the second coupling portion by pressing the third ground-side terminal portion toward the second coupling portion. Thus, the third ground wire connected to the third wire-side terminal portion of the third ground terminal can be reliably connected to at least one of the first and third ground locations.

Further, preferably, the third wire-side terminal portion and the third ground-side terminal portion are linearly connected relative to each other and the second coupling portion is coupled to the third ground-side terminal portion so that the third wire-side terminal portion is inclined in a direction toward the first wire-side terminal portion with distance from the first ground-side terminal portion.

According to such a configuration, even if an existing ground terminal structured such that a wire-side terminal portion and a ground-side terminal portion are linearly arranged relative to each other as the third ground terminal, the third wire-side terminal portion can be obliquely arranged in the direction toward the first wire-side terminal portion with distance from the first ground-side terminal portion by coupling the third ground-side terminal portion to the second coupling portion. This enables the third ground wire connected to the third wire-side terminal portion to be obliquely inclined to approach the first ground wire connected to the first wire-side terminal portion with distance from the first ground-side terminal portion in a manner similar to the above. As a result, the wire arrangement space can be reduced in the case of collectively connecting the first to third ground wires to the ground locations. Further, since an existing ground terminal can be utilized as the third ground terminal, parts can be shared.

Further, the third wire-side terminal portion is preferably obliquely connected to the third ground-side terminal portion so that the third ground wire connected to the third wire-side terminal portion extends in a direction toward the first ground wire connected to the first wire-side terminal portion with distance from the first ground-side terminal portion in a state where the third ground-side terminal portion is coupled to the second coupling portion.

According to such a configuration, the third wire-side terminal portion is obliquely connected to the third ground-side terminal portion. Thus, in performing an operation of coupling the third ground-side terminal portion to the second coupling portion, it is not necessary to proceed with the coupling operation while considering an angle of inclination between the first ground wire and the third ground wire, whereby a reduction in operation speed can be suppressed. In addition, in the state where the third ground-side terminal portion is coupled to the second coupling portion, the third wire-side terminal portion can be obliquely arranged in the direction toward the first wire-side terminal portion with distance from the first ground-side terminal portion. This enables the third ground wire connected to the third wire-side terminal portion to be obliquely arranged to approach the first ground wire connected to the first wire-side terminal portion with distance from the first ground-side terminal portion in a manner similar to the above. As a result, the wire arrangement space can be reduced in the case of collectively connecting the first to third ground wires to the ground locations.

The invention claimed is:

1. A ground connection body for collectively connecting ground wires to a plurality of ground locations provided on a wall surface in a vehicle, comprising:

a first wire-side terminal portion shaped to be connectable to an end of a first ground wire;

a second wire-side terminal portion shaped to be connectable to an end of a second ground wire different from the first ground wire; and a first ground-side terminal portion electrically connected to each of the first and second wire-side terminal portions, including a first ground location connection part connectable to a first ground location and a second ground location connection part connectable to a second ground location different from the first ground location and having such a relative positional relationship that the first and second ground location connection parts are simultaneously connectable to the first and second ground locations;

wherein the second wire-side terminal portion is obliquely arranged relatively with respect to the first wire-side terminal portion so that the second ground wire connected to the second wire-side terminal portion extends in a direction toward the first ground wire connected to the first wire-side terminal portion with distance from the first ground-side terminal portion.

2. A ground connection body according to claim 1, wherein end parts of the first and second wire-side terminal portions closer to the first ground-side terminal portion are arranged in a direction parallel to an arrangement direction of the first and second ground location connection parts of the first ground-side terminal portion.

3. A ground connection body according to claim 1, wherein the second wire-side terminal portion is obliquely arranged relatively with respect to the first wire-side terminal portion so that an axial direction thereof is inclined with respect to that of the first wire-side terminal portion.

4. A ground connection body according to claim 1, further comprising a second ground-side terminal portion including a first ground location connection part connectable to the first ground location in addition to the first ground-side terminal portion, wherein:

the ground connection body includes a first ground terminal and a second ground terminal;

the first ground terminal is formed by connecting the first wire-side terminal portion and the first ground-side terminal portion;

the second ground terminal is formed by connecting the second wire-side terminal portion and the second ground-side terminal portion; and the first ground-side terminal portion includes:

a first coupling portion to be coupled to the second ground-side terminal portion in such a relative positional relationship that the first ground location connection part of the first ground-side terminal portion and the first ground location connection part of the second ground-side terminal portion are simultaneously connectable to the first ground location, and a first crimping portion configured to crimp the second ground-side terminal portion to the first coupling portion by pressing the second ground-side terminal portion toward the first coupling portion.

5. A ground connection body according to claim 4, wherein:

the second wire-side terminal portion and the second ground-side terminal portion are linearly connected relative to each other; and the first coupling portion is coupled to the second ground-side terminal portion so that the second wire-side terminal portion is inclined in a direction toward the first wire-side terminal portion with distance from the first ground-side terminal portion.

6. A ground connection body according to claim 4, wherein the second wire-side terminal portion is obliquely connected to the second ground-side terminal portion so that the second ground wire connected to the second wire-side terminal portion extends in a direction toward the first ground wire connected to the first wire-side terminal portion with distance from the first ground-side terminal portion in a state where the second ground-side terminal portion is coupled to the first coupling portion.

7. A ground connection body according to claim 1, further comprising a third wire-side terminal portion shaped to be connectable to an end of a third ground wire different from the first and second ground wires, wherein:

the third wire-side terminal portion is electrically connected to the first ground-side terminal portion and obliquely arranged relatively with respect to the first wire-side terminal portion so that the third ground wire connected to the third wire-side terminal portion extends in a direction toward the first ground wire connected to the first wire-side terminal portion with distance from the first ground-side terminal portion.

8. A ground connection body according to claim 7, wherein the third wire-side terminal portion is obliquely arranged relatively with respect to the first wire-side terminal portion so that an axial direction thereof is inclined with respect to that of the first wire-side terminal portion.

9. A ground connection body according to claim 7, further comprising a third ground-side terminal portion including a second ground location connection part connectable to the second ground location in addition to the first ground-side terminal portion, wherein:

the ground connection body includes a first ground terminal and a third ground terminal;

the first ground terminal is formed by connecting the first wire-side terminal portion and the first ground-side terminal portion;

the third ground terminal is formed by connecting the third wire-side terminal portion and the third ground-side terminal portion; and the first ground-side terminal portion includes:

a second coupling portion to be coupled to the third ground-side terminal portion in such a relative positional relationship that the second ground location connection part of the first ground-side terminal portion and the second ground location connection part of the third ground-side terminal portion are simultaneously connectable to the second ground location, and a second crimping portion configured to crimp the third ground-side terminal portion to the second coupling portion by pressing the third ground-side terminal portion toward the second coupling portion.

10. A ground connection body according to claim 9, wherein:

the third wire-side terminal portion and the third ground-side terminal portion are linearly connected relative to each other; and the second coupling portion is coupled to the third ground-side terminal portion so that the third wire-side terminal portion is inclined in a direction toward the first wire-side terminal portion with distance from the first ground-side terminal portion.

11. A ground connection body according to claim 9, wherein the third wire-side terminal portion is obliquely connected to the third ground-side terminal portion so that the third ground wire connected to the third wire-side terminal portion extends in a direction toward the first ground wire connected to the first wire-side terminal portion with distance from the first ground-side terminal portion in a state where the third ground-side terminal portion is coupled to the second coupling portion.

* * * * *